US005172776A

United States Patent [19]

Wilschek

[11] Patent Number: 5,172,776

[45] Date of Patent: Dec. 22, 1992

[54] DIAMOND DRILL CHUCK JAW CARRIER AND ASSEMBLY

[76] Inventor: Kenneth E. Wilschek, 748 Shaw Avenue, Coquitlam, British Columbia, Canada, V3K 2R8

[21] Appl. No.: 689,376

[22] Filed: Apr. 22, 1991

[51] Int. Cl.[5] ..... E21B 19/10

[52] U.S. Cl. ..... 175/162; 175/423; 166/77.5; 279/123

[58] Field of Search ..... 175/162, 423, 122, 170, 175/195; 166/77.5, 78, 85; 279/15 J, 123

[56] References Cited

U.S. PATENT DOCUMENTS

| | | | |
|---|---|---|---|
| 2,002,387 | 5/1935 | Bannister . | |
| 2,317,306 | 4/1943 | Smith . | |
| 2,998,084 | 8/1961 | Johnson et al. . | |
| 3,131,776 | 5/1964 | Kvello-Aune et al. . | |
| 3,144,085 | 8/1964 | Hasha . | |
| 3,399,735 | 9/1968 | Ikeda . | |
| 3,623,742 | 11/1971 | Funk et al. | 279/65 |
| 3,679,221 | 7/1972 | Behrens | 279/123 X |
| 4,429,753 | 2/1984 | Cushman . | |
| 4,587,708 | 5/1986 | Miyachi | 279/123 X |
| 4,594,036 | 6/1986 | Hogenhout | 279/74 X |
| 4,735,270 | 4/1988 | Fenyvesi . | |

*Primary Examiner*—Terry Lee Melius
*Attorney, Agent, or Firm*—Wood, Phillips, Van Santen, Hoffman & Ertel

[57] ABSTRACT

This invention relates to diamond drills drive apparatus and in particular, to an improved diamond drill chuck jaw carrier and related assembly. The apparatus comprises a hydraulically operated vane motor concentrically mounted about the axis of rotation of a drill rod string for rotating two independently driven chuck jaw carrier assemblies about the axis. Each chuck jaw carrier assembly receives the rod string within a central aperture and comprises floating chuck jaw wheel assemblies and flying wedge assemblies. The flying wedge assemblies slidably force the chuck jaw wheel assemblies into removable engagement with the drill pipe. The chuck jaw wheel assemblies further comprise hydraulically operated vane motors driving tiers of chuck jaw wheels. The chuck jaw wheels have toothed surfaces for gripping engagement of the drill pipe. Rotation of the carrier assemblies drives the drill string; independent rotation of the upper and lower carrier assemblies permits coupling or decoupling of adjoining drill rod sections. Rotation of the chuck jaw wheels moves the rod string up or down relative to the drive apparatus.

18 Claims, 17 Drawing Sheets

DIAMOND DRILL CHUCK JAW CARRIER AND ASSEMBLY

FIELD OF THE INVENTION

This invention relates to drive apparatus for diamond drills, and in particular, to improved diamond drill chuck jaw carriers and related assembly.

BACKGROUND OF THE INVENTION

A diamond drill consists of a power unit rotatingly driving a tubular steel bit. Diamonds are set into the face of the bit so as to allow drilling into rock or the like. The bit and an attached core barrel are rotated at speed under controlled longitudinal pressure by means of rotating hollow, steel, flush-jointed rods threaded onto the core barrel. Water is pumped through the rods to cool the bit and to remove rock cuttings.

With the advance of the bit through the rock, a cylindrical core of rock passes up into the core barrel. Two types of rod strings are in current use, "standard" and "wireline".

In "standard" drilling, when the core barrel is full of core or blocked in such a manner as to prevent further core from entering the core barrel, the rod string is pulled out of the hole and the core is removed from the core barrel and placed in boxes suitable for examination and storage. The core barrel and rod string are then put back down the hole and drilling continues.

In "wireline" drilling the core is collected in a thin walled inner core barrel which is resident inside the thick outer core barrel. Drilling continues until the inner core barrel is full or blocked in such a manner as to prevent further core from entering the core barrel. This inner core barrel, full of the cut core, may be retrieved by passing a special tool, which is connected to a thin cable, down the centre of the rod string. The inner core barrel is hoisted up without the removal of the rod string from the hole and an empty inner core barrel is pumped down to the bottom of the hole to replace it. Drilling continues. The core from the inner core barrel is emptied into boxes suitable for examination and storage.

In both cases, it is required to pull the rod string for many reasons: when changing the bit, when the bit is clogged, when the hole is finished, when setting a wedge, etc.

A conventional diamond drill arrangement typically consists of a steel motor-mount frame on which is mounted a conventional gasoline or diesel motor which, through a clutch and transmission, supplies power to a drum for hoisting drill rods and which also supplies power to the drill head so as to rotate the drill rod in the drill hole. The drum winds a wire cable through a wheel at the top of a second bore hole head frame, erected over the drill hole, so as to enable the hoisting of the drill rods out of the drill hole. The cable is typically removably attached to the drill rods by means of a hoisting plug.

Two types of drilling heads are in common use, a screw feed head and a hydraulic feed head. In both arrangements power is transmitted from the motor through a transmission and clutch to a set of crown and bevel gears. In the screw feed arrangement, the feed screw rotates so as to rotate the rods, core barrel and drill bit. In the screw feed head, an arrangement of gears rotates the feed screw so as to advance the drill rods longitudinally. At the bottom of the feed screw is a multiple-jawed chuck through which the drill rods pass. The chuck jaws are manually clamped onto the drill rod so as to hold the drill rod in the feed screw.

During drilling operations, when the feed screw has run its full length, the chuck is loosened and the feed screw and chuck run back through the gearing in the drilling head so as to engage the next length of drill rod by the manual tightening of the chuck jaws onto the drill rod. This operation continues for five to ten feet or until the capacity of the core barrel has been reached.

When "standard" rods are used, the drill rods are then hoisted up to the top of the frame and then removed, usually in twenty- or thirty-foot sections, until the core barrel is eventually pulled to the surface and disconnected. The bit is then detached and the core removed from the core barrel. The bit and core barrel are then reattached to the drill rods, the drill rods lowered into the hole, and the whole process is then repeated.

When "wireline" rods are used, the rod string is pulled out of the drill hole until the first available joint is reached. The rods are disconnected at this joint, and a latch device, to which a thin cable is attached, is dropped or pumped down the hole to retrieve a thin inner core barrel which contains the core. The inner core barrel is hoisted out of the rod string and an empty one is pumped to the bottom of the hole. In this manner drill holes up to thousands of feet long (at least for geological surveying) are advanced into the bedrock.

The hydraulic drill head arrangement merely replaces the screw feed with hydraulic rams for urging the drill rod longitudinally into, or out of, the drill hole. Again, the drill rod is held in a chuck. One additional feature, however, is that the chuck is hydraulically operated. Hydraulic chucks reduce the time required to both disengage the drill head from the drill rod and reengage the drill head at a different position along the drill rod.

Drill rods typically have screw-threaded male and female ends so that the rods may be threaded one onto another so as to form a drill rod string in the drill hole. The screw-threaded joints between the rods are tightened by the rotation of the drill rod string during drilling operations. Each time the rod string is hoisted from the hole, the screw threaded joint between every second or third rod must be undone. This requires that the frictional engagement between the rod ends in the joint be "broken" before the joint can be unscrewed. This is relatively inconvenient to accomplish with a conventional diamond drill, (either screw-feed or hydraulic-feed type) because the drill rod string is held by only one chuck. Thus, any rotation of the drill rods relative to the chuck (so as to unscrew a drill rod from the drill rod held in the chuck) must be the result of a rotational force applied relative to the chuck. This is typically accomplished by holding a pipe wrench in operative engagement with the rod string on the drill rod which is not held by in the chuck. The handle of the pipe wrench is rested against a portion of the drill so as to prevent the rod string from rotating, and then rotating the drill rod held in the chuck in a direction which breaks the joint and unscrews the screw threaded joint. Further, because of the location of the slightly oversized joint and knobbed thread adaptor between the rod string and the core barrel, the conventional chuck cannot be used to grip the core barrel while the last rod of the rod string is removed. This is because the chuck will not accommodate the slightly oversized joint. Consequently, the core barrel must be manually held above the drill hole once the last of the drill rods are removed from the core barrel. This is a difficult and potentially hazardous task.

U.S. Pat. No. 4,429,753, Cushman, issued Feb. 7, 1984, illustrates a simultaneous rotation and pull-down-/pull-up mechanism for use on drill pipes. The drill incorporates feed rollers which grip the drill pipe between concave recesses on the rollers. The feed rollers are held in a superstructure which rotates so as to rotate the drill pipe. The rollers are aligned so that rotation of the rollers raises or lowers the drill pipe. The drill pipe may thus be rotated as it is being raised or lowered. The Cushman device has the serious disadvantage that the chuck will not automatically accommodate varying diameters of drill pipe. Further, the use of a plurality of tiers of wheels is not suggested. In view of the non-adjustability of the chuck, Cushman did not envisage an adjustable chuck using a plurality of tiers of chuck jaw wheels that would enable the retention of a core barrel in a lower tier while allowing removal of the rod string using an upper tier.

Cushman also fails to take into account the magnitude of the rotational force required to rotate a drill rod string on a drill hole. The magnitude of the force and torque required to be applied to a rod string in order to manipulate the rod string in a drill hole prohibit the use of "operative frictional engagement" through concave wheel surfaces as described by Cushman. It has been found that in order to take advantage of the bearing and shear strength of the rod steel so as to apply the required torque, it is necessary to penetrate many points on the surface of the rod with teeth on a chuck jaw wheel to a depth of up to 0.045 in. In this manner, sufficient force can be applied so as to manipulate the drill rod string in the drill hole.

The mechanism described by Cushman further fails to provide a means for positively locking the drive rollers and preventing them from turning when this is required, such as when the rod string is part way up the hole when the rods are being pulled. At best, the device described by Cushman would rely on the pull-down-/pull-up hydraulic motor to provide a brake force. If this motor were to leak fluid, as hydraulic motors are prone to do, especially when they are approaching the end of their useful life, or if the conduits supplying fluid to the motor were to break, a relatively common occurrence, then the drive rollers would be free to rotate, allowing the disconnected rod string to fall down the hole.

Of particular importance is the fact that Cushman does not provide a means for applying rod-string gripping force when the drill is not rotating. Torque must be applied for operative frictional engagement. This is unsatisfactory, because when the drill is stopped, there should be some means of gripping the rod-string to prevent its falling into the drill hole.

U.S. Pat. No. 2,002,387, Bannister, issued May 21, 1935, discloses a positive displacement rotary hydraulic motor which is mounted concentrically on a drill pipe. The Bannister device requires that the circulating wash fluid, used to flush the rock debris from the drill face, be used to drive the rotation of the drill motor. The motor is located in proximity to the drill bit, that is, it is located at the bottom of the drill hole. The use of independent hydraulic vane motors for independently rotating or braking the rotation of tiers of chuck jaws is neither taught not suggested. Further, the use of hydraulic vane motors to drive chuck jaw wheels is neither taught nor suggested.

SUMMARY OF THE INVENTION

The diamond drill of the present invention differs substantially from conventional diamond drills. Instead of using a conventional motor driving a transmission to turn a crown and bevel gear assembly so as to rotate the chuck jaw assembly, a hydraulic vane motor, concentrically mounted around the drill rod string, is used to power a planetary gear assembly, also concentric to the drill rod string, which in turn rotates the drill rod string via the chuck jaw assembly.

The diamond drill of the present invention also differs from conventional diamond drills in that instead of a chuck jaw arrangement which is stationary relative to the drill rod string, and instead of downward or upward longitudinal pressure being transferred to the drill rods by longitudinal force applied directly to the chuck jaw arrangement, the drill of the present invention incorporates two tiers of chuck jaw wheels which rotate relative to the drill rod string to impart downward or upward pressure. The two tiers of chuck jaw wheels may be locked either in tandem or independent of one another so as to either prevent rotation of the entire drill rod string or to hold stationary one drill rod while an adjoining drill rod is rotated so as to break the screw threaded joint and unscrew one drill rod from the other.

In summary, in a preferred embodiment, a diamond drill chuck jaw carrier and assembly comprises a hydraulically operated vane motor mounted concentrically with the axis of rotation of a drill pipe. The vane motor rotates a chuck jaw carrier assembly about the same axis. The chuck jaw carrier assembly carries floating chuck jaw wheel assemblies and flying wedge assemblies. (The term "floating", when applied to the chuck jaw assemblies, is meant to imply that the chuck jaw wheel assemblies are free to travel in a radial direction subject to constraints imposed by the flying wedges. Each of the chuck jaw assemblies may be loosely coupled to its associated flying wedge by a pin in the chuck jaw assembly which loosely engages a slot in the flying wedge. This loose interconnection allows each of the chuck jaw assemblies to be pulled radially outward as the flying wedges are turned counter to the usual direction of rotation of the rod string). The flying wedge assemblies act, in conjunction with their associated lock pin assemblies, to force the chuck jaw-wheels into gripping engagement with the outer surface of the drill pipe. The flying wedge assemblies move circumferentially and in so doing, (in driving mode) bring an increasing width of wedge into engagement with the outer bearing surfaces of the chuck jaws, thereby forcing the chuck jaws to move radially inwards, forcing them to dig into and grip the rod string. The maximum circumferential travel is limited by the lock pin assemblies when the lock pin assemblies are in their elongated state. This in turn limits the maximum radial travel of the chuck jaw assemblies. When the lock pin assemblies are in their contracted state, the flying wedge assemblies are permitted to move a considerable distance, hence the chuck jaw assemblies are capable of moving a considerable radial distance toward or away from the axis of rotation of the rod string. Because of this, the chuck jaw carrier assembly is capable of accepting rod strings of varying diameters without the need to change chuck jaw wheels or other components of the drill. The chuck jaw wheel assemblies carry hydraulically operated vane motors which drive upper and lower tiers of chuck jaw wheels. The chuck jaw wheels use toothed surfaces to grippingly engage the drill pipe. The axes of rotation of the chuck jaw wheels lie in a radial plane relative to the rod string axis, i.e. a plane which is substantially orthogonal to the axis of rotation of the chuck jaw carrier assembly and drill pipe. The wheels are aligned so as to bring the toothed surfaces of all the chuck jaw wheels into engagement with the drill pipe. Rotation of the chuck jaw wheels thus acts to raise or lower the drill pipe along the drill pipe axis of rotation. The engagement of the chuck jaw wheels with the drill pipe allows for the rotation of the drill pipe by rotating the chuck jaw carrier assembly. This provides the rotation of the drill pipe required for drilling operations. All the chuck jaw wheels in all the chuck jaw assemblies within a given chuck jaw carrier assembly will lock simultaneously upon the proper application of fluid pressure. However, the chuck jaw wheels in a given chuck jaw carrier assembly (the upper or lower assembly) may be locked independently of the chuck jaw wheels in the other chuck jaw carrier assembly. This allows the lower chuck jaw carrier assembly chuck jaw wheels (say) to be locked and prevented from rotating while the chuck jaw wheels in the upper carrier assembly are free to rotate. The locked chuck jaw wheels in the lower chuck jaw carrier assembly act as a foot clamp and prevent the rod string from sliding down the hole. The chuck jaw wheels in the upper chuck jaw carrier assembly, being free to rotate, allow that portion of the rod string above the lower chuck jaw carrier assembly to move parallel to the axis of rotation of the rod string. By raising or lowering the rod string such that a joint exists between the two carrier assemblies and then locking the lower chuck jaw assembly, that part of the rod string existing above said joint may be unscrewed from the lower part by counter-rotating the upper chuck jaw carrier assembly with respect to the lower chuck jaw carrier assembly. The upper part of the rod string, being free to move longitudinally, allows the rod string joint to expand while it is unscrewed and prevents binding of the threads.

The entire drill drive assembly is hydraulically operated. Fluid power for the drill is obtained through a prime mover driving a plurality of hydraulic pumps. The fluid supplying the drill is routed through a hydraulic control board. This board uses conventional techniques to control fluid pressures and volume flow rates.

In somewhat more detail, in the preferred embodiment, a source of hydraulic fluid is used to drive a vane motor which is mounted within a pivotally supported cylindrical canister. The canister is mounted concentrically with the rod string over the drill hole so that drill rods pass through the hollow interior of the canister and into the drill hole. The canister is pivotally mounted so that holes may be drilled at an angle from the vertical.

The vane motor within the canister also concentrically mounted relative to the rod string, drives an oversized hexagonal tube drive shaft which in turn is connected to a transmission. The drive motor and transmission are within and fixed to, and therefore do not rotate relative to, the canister. Rather, their rotary motion is transferred to upper and lower rotating chuck jaw assemblies as follows:

The transmission rotates upper and lower hexagonal tube drive shafts which are themselves coaxial with the bore in the drill drive assembly through which the drill rods are passed. These drive shafts in turn rotatingly drive upper and lower baskets to which they are attached. The lower hexagonal tube drive shaft fits within the oversized hexagonal drive shaft between the drive motor and the transmission and extends from the transmission through the drive motor and through a rotating fluid interface so as to engage the lower basket. A similar rotating fluid interface unit is provided for the upper basket.

The rotating fluid interface units are required so that hydraulic fluid can be supplied under pressure to the chuck assemblies contained within the upper and lower baskets, so as to provide power for the rod string gripping wheels in the chuck jaw.

The upper and lower baskets each contain slidably mounted floating chuck jaw assemblies. The floating chuck jaw assemblies are free to slide in radial guides in upper and lower generally circular platens or support disks. These guides extend radially outwards from the drill rods bore, i.e. from the central aperture in the basket through which the rod string passes. Each basket encases the upper and lower platens or support disks in which the radial guides are machined. Each of the support disks also serves as a support upon the periphery of which the flying wedge assemblies may pivotally and slidably move. By rotational engagement of the baskets via drive transfer rollers with the flying wedge assemblies on the support disks, the flying wedge assemblies are driven along guides machined in the support disks so as to force the wedges to slide between restraint bars spaced about the periphery of the support disks and outer bearing surfaces of the floating chuck jaw assemblies. As the wedges move circumferentially in "tightening" mode, an increasing width of wedge is presented between the fixed restraint bars and the outer bearing surface of the floating chuck jaws, subject to the constraint in circumferential travel of the flying wedges imposed by the extended lock pin assemblies. The chuck jaw assemblies are thus driven radially inward along the guides in the support disks so as to drive the inner face of the chuck jaw assemblies (out of which the gripping wheels protrude) further against the periphery of a drill rod string residing in the drill rod bore, providing increased gripping ability as torque applied to the rod string is increased. The lock pin assemblies, being in their extended position, ensure that at least a desired minimum penetration of the chuck jaw wheels into the rod string occurs. This is necessary to ensure the rod string may be suspended by the chuck jaw wheels under conditions of zero torque applied to the rod string.

The floating chuck jaw assemblies support rotatably mounted toothed gripping wheels which protrude from the front faces of the floating chuck jaw assemblies. The toothed gripping wheels are aligned and rotate about an axis radial to the rod string axis so that when engaged with a drill rod residing in the drill rod bore, rotation of the gripping wheels raises or lowers the drill rod. The toothed gripping wheels are hydraulically driven by vane motors within the floating chuck jaw assemblies.

The upper and lower baskets may be rotated independently of one another so that a drill rod held by the toothed wheels of the chuck jaw in the upper basket may be coupled to or uncoupled from another drill rod held by the toothed wheels of the chuck jaw in the lower basket. Further, the size of the drill rod which can be accommodated is only limited by the diameter of the drill rod bore through the concentrically mounted elements of the drill drive apparatus and the maximum permitted radial movement of the chuck jaws. As long as the drill rod bore is sufficiently large enough, the oversized joint between the drill rods and the core barrel can be passed through the lower basket so that the core barrel can be held by the chuck jaws in the lower basket, whilst the upper basket is rotated to decouple the drill rod from the core barrel.

To release the upper or lower chuck jaws from engagement with a drill rod, the basket containing the selected chuck jaw assembly is merely rotated in a reverse direction while the lock pins are set to their retracted state so as to disengage the flying wedges from the outer bearing surfaces of the floating chuck jaw assemblies, thereby allowing the chuck jaw assemblies to move radially outward (which will tend to happen as a consequence of the loose interconnection between the pin in the chuck jaw assembly and its associated slot in the flying wedge. Note also that disengagement tends to be encouraged by the centripetal force resultant from the rotation).

The following advantages are thus presented over the current diamond drilling technology:

(1) The drill will accept various rod diameters, for example, rod diameters from 2.1 inches to 4.6 inches (trade sizes BQ to PQ[HW]) without the need to change chuck jaws as would currently be required.

(2) The core barrel coupling and thread adapter (for coupling the core barrel to the drill rods), which are necessarily of a greater diameter than the drill rods, may, by opening the chuck jaws, be hoisted through the chuck jaw assembly. In the past this was not possible; the core barrel had to be detached from the drill rod string below the chuck jaws. This was a difficult operation as the chuck jaws could not be used to prevent the core barrel from falling back into the hole. The present invention has the advantage that at least one tier of chuck jaws may be closed on the core barrel when the core barrel is removed from the drill rod string. The removal of the core barrel from the drill hole may be accomplished without detaching the core barrel from the drill rod string below the chuck jaw assembly.

(3) rod string may be pulled hydraulically and automatically by hoisting the rod string under the rotating action of the chuck jaw wheels. After a certain length of rods have been hoisted out of the drill hole, the rods may be disconnected from the rod string by locking the lower chuck jaw carrier assembly and rotating the upper chuck jaw carrier assembly relative to the lower chuck jaw carrier assembly so as to break the threaded engagement of the drill rods held in the chuck jaws and unscrew one rod from the other.

(4) The integrated structure of the drill permits the drill to be slung under a helicopter as a balanced load. The use of pin-in-hole connection methods between interconnecting parts in a preferred embodiment permits faster and safer helicopter undercarriage slinging. This offers the further advantage of reducing helicopter hovering time required over the drill site and also reduces the number of helicopter trips required to transport the drill assembly due to the improved weight distribution of the sling loads. This is an important advantage in view of the frequency with which drill sites are moved, especially during geological exploratory drilling programs.

(5) The improved configuration of the chuck jaws in relation to the drill mount allows for increased effective stiffness of the frame connecting the drill rod string to the ground through the drill case. This reduces the vibration induced by the rotation of the drill rod string. This has the important advantage of reducing the magnitude of the forces and torques required to manipulate a drill rod string in a drill hole.

It will be seen that there are several inventive aspects of the entirety of the drill drive apparatus herein described and various of its subassemblies and components. These are particularized in the appended claims.

BRIEF DESCRIPTION OF THE DRAWINGS

FIGS. 3 to 14 illustrate preferred embodiments of components of a diamond drill chuck jaw carrier and assembly constructed in accordance with the principles of the present invention.

FIG. 3 is an exploded isometric view of the drill case.

FIG. 4 is an exploded isometric view of the lower canister of the drill case of FIG. 3, and its contents.

FIG. 5 is an exploded isometric view of the upper canister of the drill case of FIG. 3, and its contents.

FIG. 6 is a partially exploded isometric view of the lower carrier assembly drive basket, one of the components housed within the lower canister of FIG. 4.

FIG. 7 is an exploded isometric view of an internal carrier assembly, one of the components of the drive basket of FIG. 6.

FIG. 11 is an isometric view of an alternative chuck jaw assembly for use in the internal carrier assembly of FIG. 7.

FIG. 12 is an exploded isometric view of the chuck jaw assembly of FIG. 11.

FIG. 13 is an exploded isometric view of an alternative embodiment of a chuck jaw wheel assembly of the type shown in the chuck jaw assembly of FIG. 12.

FIG. 14 is an exploded view of a rotating fluid interface one of the components illustrated in FIG. 4.

DETAILED DESCRIPTION OF THE PREFERRED EMBODIMENT

Figure 3:
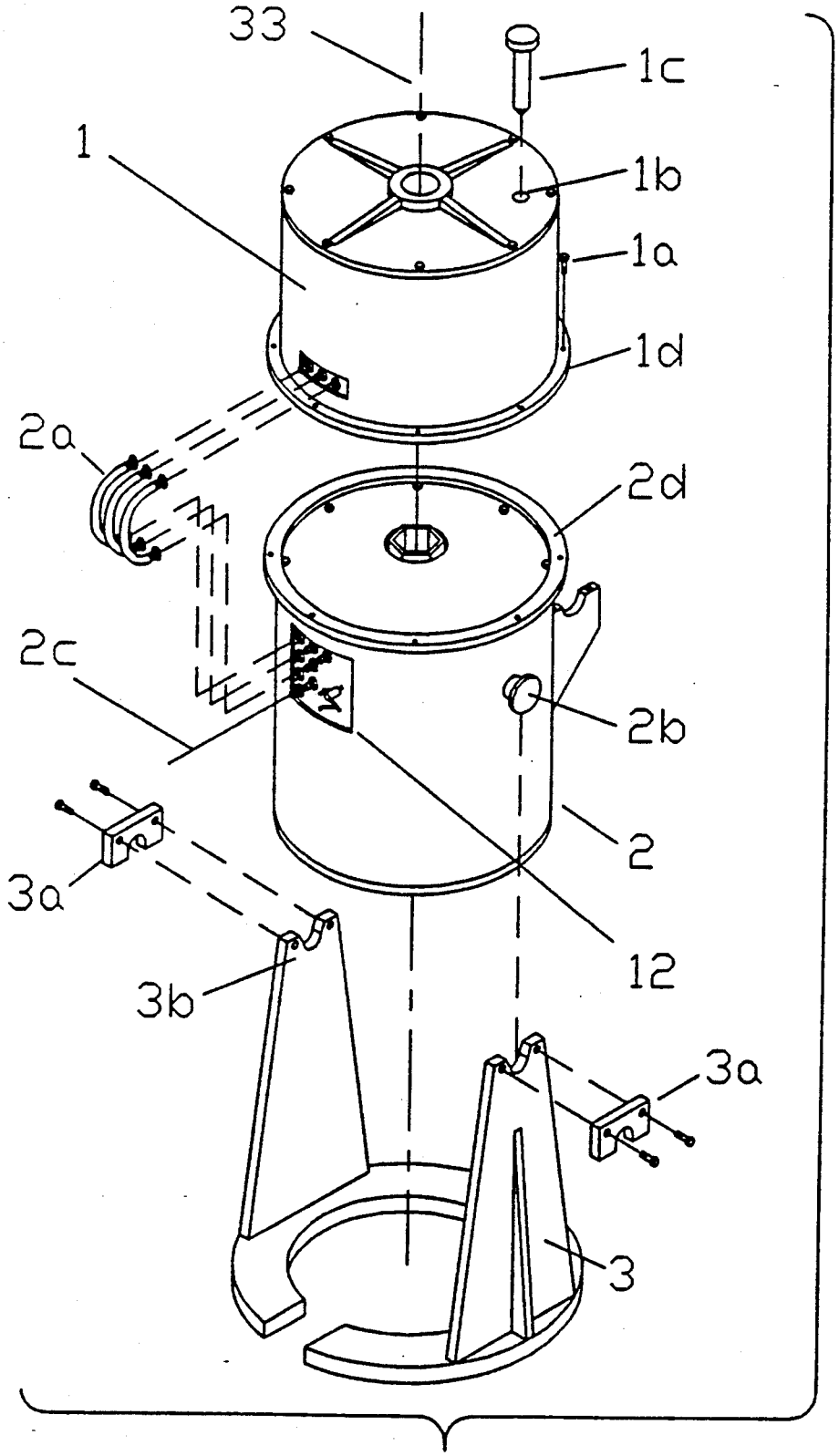

As illustrated in FIG. 3, the canister shell assembly forming the drill case generally indicated as A consists of three modules, viz. upper canister 1, lower canister 2, and drill case mounting platform 3. Lower canister 2 is supported by journals 2b pivotally engaging trunnion mountings 3b on platform 3. Lower canister 2 is secured to mount 3 with trunnion caps 3a. Upper canister 1 is bolted to the top of lower canister 2 by a plurality of bolts 1a spaced around the mating flanged end portions 1d, 2d of the two canisters. A plurality of quick-lock hydraulic hoses 2a are used to operatively interconnect the hydraulic circuits of the upper and lower canisters. Hydraulic fluid enters the drill at fluid interface unit 12 from a source of fluid via hydraulic control board (not shown) through hydraulic hose harness (shown as line 2c) at a pressure and flow rate metered by the hydraulic control board.

In this description, only cursory and superficial detail will be given of the hydraulic circuits, controls and shelf hardware, except where the related structure or operation is unusual or unique to the present invention. The reason is that, except as will be described, the hydraulic system elements are conventional and readily commercially available, and detailed description of such elements and their operation would render this specification unduly prolix.

Figure 4:
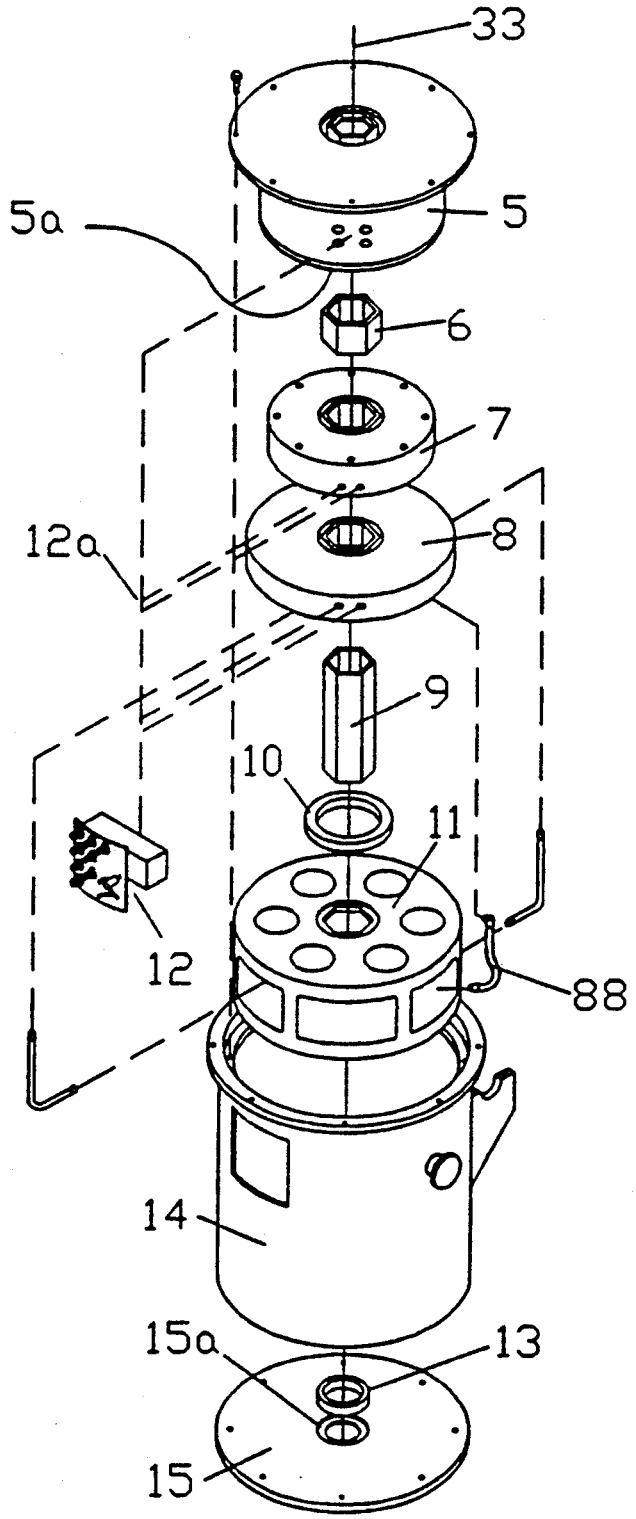

As illustrated in FIG. 4, the fluid for rotation drive motor 7 within lower canister 2 is routed from fluid interface unit 12 via hydraulic hose harness 12a. Rotation drive motor 7 is a balanced, split vane-type vane motor. Typical maximum flow characteristics of this motor in the preferred embodiment would be a volumetric flow rate of 4.5 L/s (9.54 cfm) at 2200 psi (15.17 mpa). power is transferred from rotation drive motor 7 to transmission 5 via the input shaft 6 of hexagonal cross-section, which seats in central hexagonal aperture 5a of the rotary portion of transmission 5. The planetary drive assembly incorporated by transmission 5 is of a type well known in the art e.g. as incorporated in automotive automatic transmissions and Caterpillar Tractor final drives. The gear diameters of the planetary gear assembly used in the preferred embodiment is in the rough order of that used in the final drive of Caterpillar D7 tractors but of course gears used in the present drill drive assembly may be thinner because of the lower loading of the drill compared to that of a D7 tractor. It allows for three drive ratios of approximately 2:1, 1:1, and 1:2. Shifting is accomplished by controlling the relative position of a sliding ring gear actuator (not shown). The drive ratio is changed only when the drill is not turning.

Torque for rotation of lower chuck jaw carrier assembly 11 is supplied through the connection of the carrier assembly drive basket 27 (not shown in FIG. 4 but illustrated in FIG. 6 inverted as it would be held in the upper chuck jaw carrier assembly 18 illustrated in FIG. 5) to the output of transmission 5 through lower output shaft 9, also of hexagonal cross-section. The hexagonal drive stub of shaft 9, press fit into the inner diameter of bearing 19, is also rigidly fastened to the drive basket 7. Spacer/bearing 10 (see FIG. 4a) prevents the chuck jaw carrier assembly 11 from contacting stationary portions of a rotating fluid interface unit 8, to be described in more detail below.

Figure 4A:
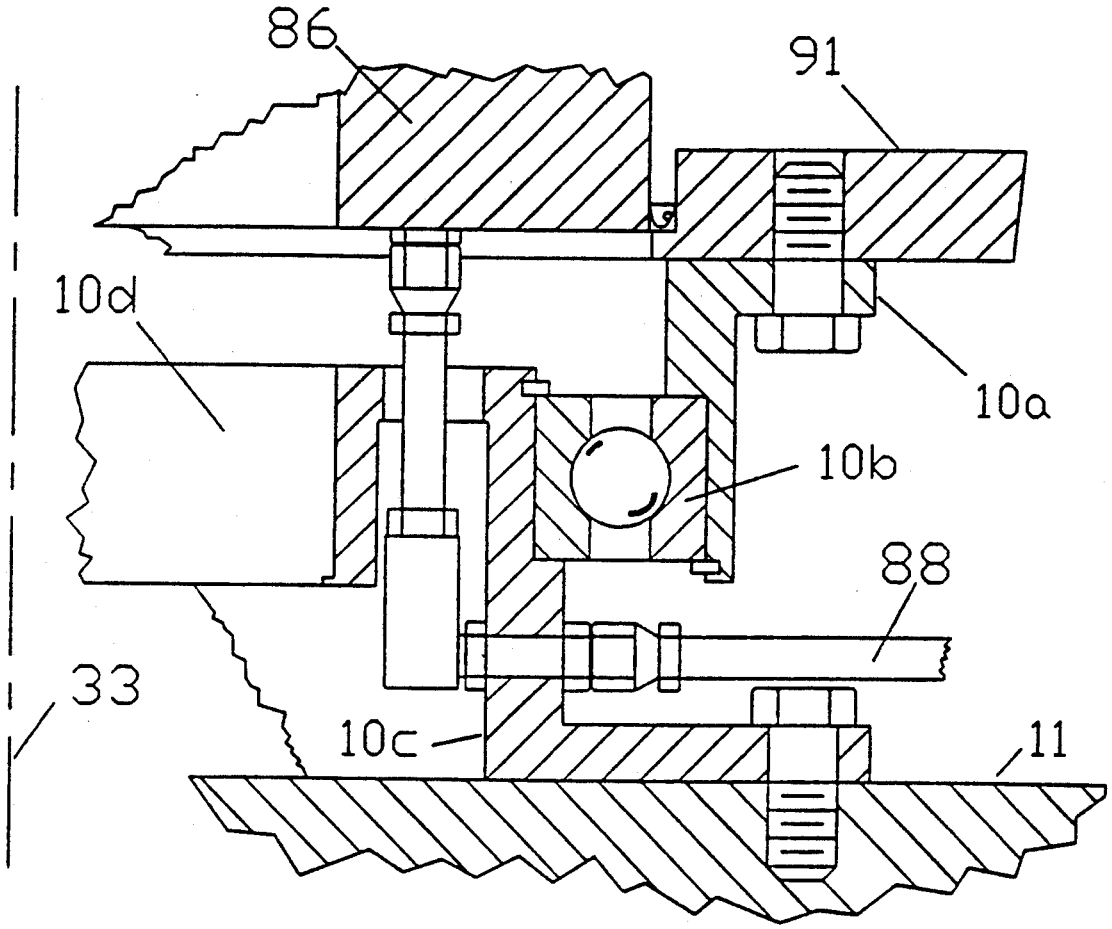
FIG. 4*a* is a section view of the spacer/bearing arrangement between the chuck jaw carrier basket and fluid interface unit.

Spacer/bearing 10 is composed of two flanges 10a, 10c, and associated fasteners, and one bearing 10b. Flange 10a is bolted to the stationary portion 91 of its associated rotating fluid interface. Bearing 10b is slide fit on flange 10a. Flange 10c is bolted to the bottom of its associated carrier basket 11, and the inside of flange 10c, surface 10d, is hexagonal to accept drive shaft 9. Bearing 10b is press fit on flange 10b. Provision is made for routing hydraulic hoses 88 as shown in FIG. 4a.

The main bearing 13, is one of two bearings 13 and 17 (bearing 17 being shown in FIG. 5) which bear the reaction thrust forces applied to drill case A by both the rod string (not shown, but indicated by the rod string axis 33 in FIG. 7) and the bearings (detailed below) which directly bear the reaction radial forces applied to drill case A from the rod string. Each of bearings 13 and 17 may consist of oppositely mounted single bearings designed to bear both radial and thrust loads, such as two-point spherical roller bearings. In the preferred embodiment, bearings 13 and 17 would comprise a combination of radial and oppositely mounted thrust bearings, for example spherical roller thrust bearings or needle roller thrust bearings in combination with cylindrical roller bearings. Thrust forces are also indirectly transferred to the case A indirectly through spacer/-bearings 10, 19 and cases of their associated rotating fluid interface.

Fluid power is supplied to the interior components of chuck jaw carrier assembly 11, which components are rotating with the rod string, from the external hydraulic control board via fluid interface 12 through lower rotating fluid interface unit 8. Lower rotating fluid interface 8 (illustrated in FIGS. 4 and 14) consists of components which are stationary with respect to the external control board, and components which rotate with the rod string. Fluid enters the stationary side of rotating fluid interface unit 8 through a plurality of hydraulic hoses in harness 12a. Fluid leaves rotating fluid interface unit 8 through a plurality of hydraulic lines 88 connected to the rotating components of rotating fluid interface unit 8. Interface unit 8 feeds hydraulic fluid to the hydraulic components of lower chuck jaw carrier assembly 11.

Lower canister 2 consists of a lower canister cylinder 14 and lower canister cap 15. Bearing 13 seats in groove 15a in cap 15. Radial and thrust force loading on bearing 13 is thus transferred to lower canister 2 through the cap 15.

Upper canister cap 16 (illustrated in FIG. 5) is similar to lower canister cap 15 and performs the same functions; namely, transferring loading from thrust bearing to upper canister cylinder 21. Bearing 17, upper chuck jaw carrier assembly 18, upper spacer/bearing 19, and upper rotating fluid interface unit 20 operate identically to the corresponding equivalent components in lower canister 2.

The lower portion 22a of upper output shaft 22 seats in hexagonal central aperture 5a of the rotary portion of transmission 5 and provides rotary energy from transmission 5 to upper chuck jaw carrier assembly 18 and upper rotating fluid interface unit 20. Upper output shaft and lower output shaft 9 are not directly connected to each other. Output shaft 9 may by a sliding collar resident in transmission 5, be disengaged from transmission 5 and locked in fixed relation to lower canister 2. Output shaft 22, whether or not output shaft 9 remains engaged to transmission 5, may remain engaged to transmission 5 through a sliding collar (not shown) in transmission 5. Thus, use of the sliding collar in transmission 5 allows lower chuck jaw carrier assembly 11 to remain fixed relative to lower canister 2 while upper chuck jaw carrier assembly 18 may be rotated by drive motor 7. In this manner lower chuck jaw carrier assembly 11 may be used as a clamp to hold a rod string in the drill hole while upper chuck jaw carrier assembly 18 is used to break and unscrew the rod held in upper chuck jaw carrier assembly 18 so as to remove it from the rod string. This is necessary during pulling the rod string from the drill hole during retrieval of the core barrel.

Figure 5:
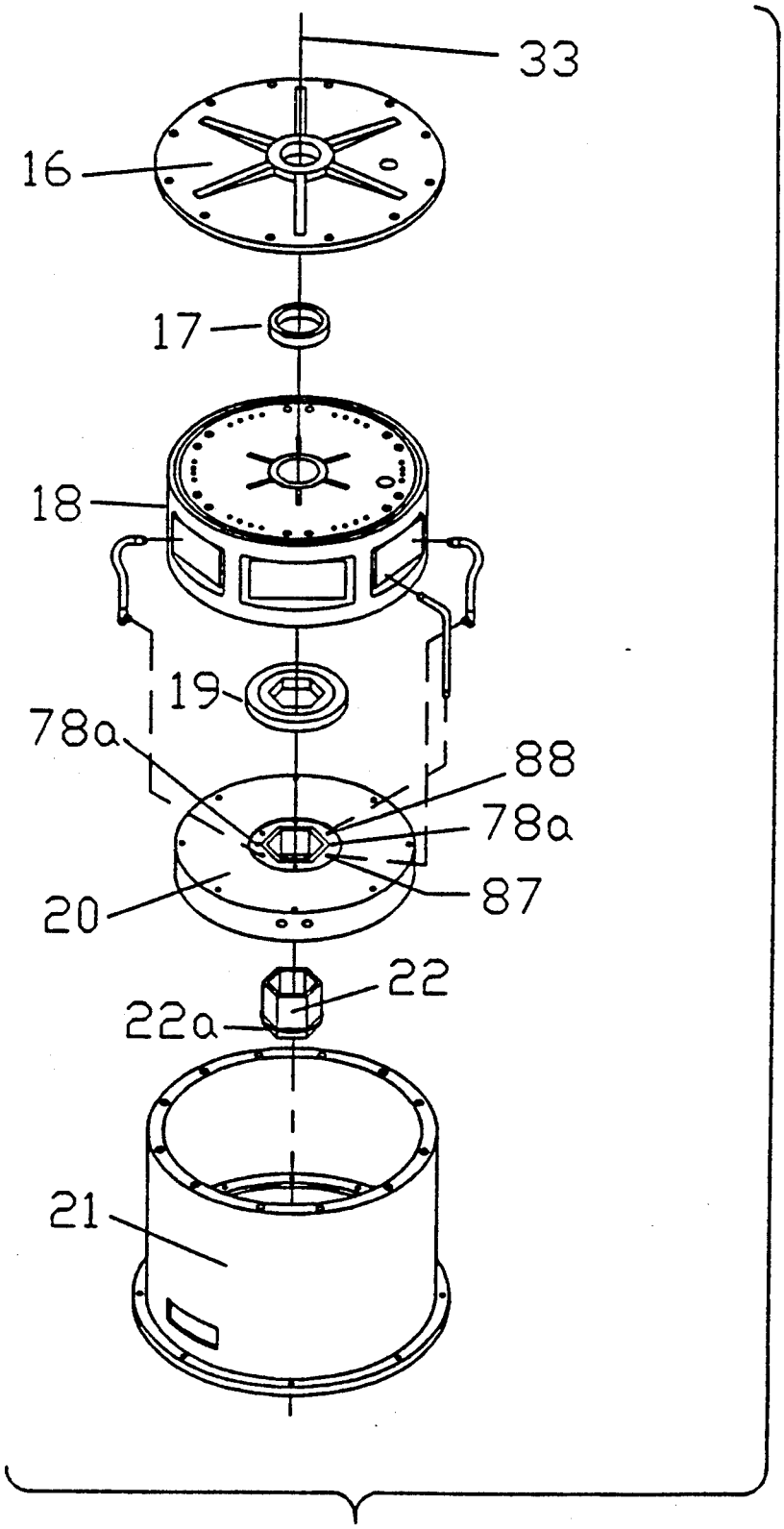
Figure 6:
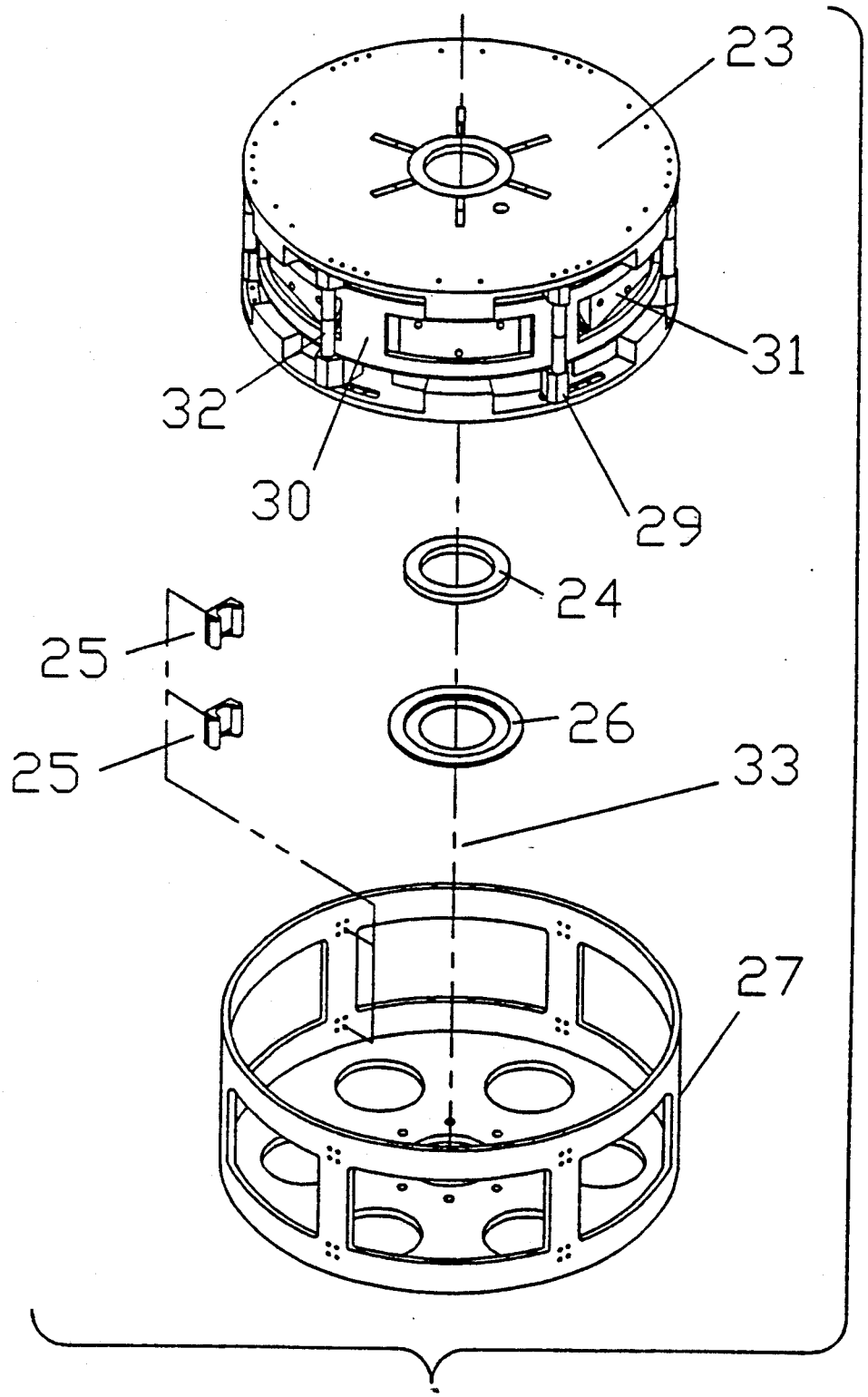

Chuck jaw carrier assemblies 11 and 18 (FIGS. 4 and 5), as illustrated in FIG. 6, each comprise drive basket 27, a plurality of drive transfer rollers 25, and internal carrier assembly 23. Bearing bracket 26 and bearing 24 allow inner carrier assembly 23 to rotate with respect to carrier assembly drive basket 27. Chuck jaw carrier assemblies 11 and 18 provide a means to supply drive torque from drive motor 7 and the rest of the drive train to the rod string via the engagement of chuck jaw assemblies 31 with the rod string. Assemblies 11 and 18 also provide the rotating support platforms so that chuck jaw assemblies 31 can move in a radial direction relative to rod string axis 33 so as to accept drill rods of varying diameter. Lastly, chuck jaw carrier assemblies 11 and 18 support flying wedges 29 which, in conjunction with lock pin assemblies 32, maintain chuck jaw assemblies 31 in detachable engagement with the rod string and prevent slippage between chuck jaw wheels 52 (not shown in FIG. 6) and the rod string. FIGS. 10*a*, 10*b* and 11 to 13, to be discussed below, show further detail of the chuck jaw wheels 52 and other elements of the chuck jaw assembly, according to two alternative designs.

Figure 7:
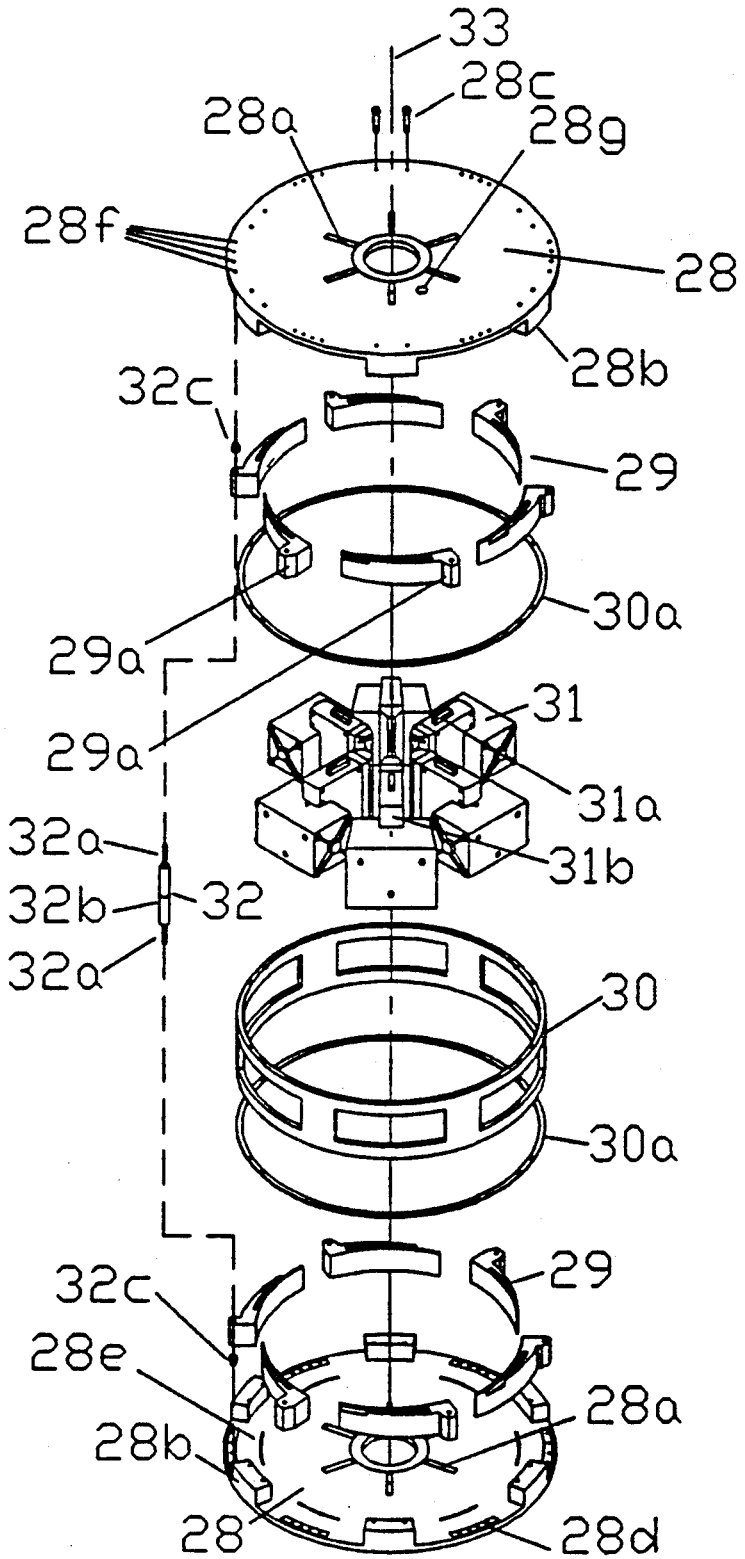

As illustrated in FIG. 7, the carrier assembly 23 consists of two support disks 28, two annular sets of flying wedges 29, a plurality of lock pin assemblies 32, a spacer 30, two wear rings 30*a*, and a plurality of chuck jaw assemblies 31 arranged in circular symmetry about the rod string axis 33, which is also the axis of symmetry for the generally circular, annular or cylindrical major components of the chuck jaw carrier and related assembly herein described.

Rotary energy to rotate the rod string is supplied by the operation of rotary drive motor 7, which transmits torque through the drive train to chuck jaw assemblies 31. Torque is transferred to chuck jaw assemblies 31 via carrier assembly drive basket 27 which in turn transfers torque to inner carrier assembly 23 via a plurality of drive transfer rollers 25 (FIG. 6) driving upper and lower sets of flying wedges 29. Drive transfer rollers 25 perform two functions. First, they allow for slippage, parallel to the axis of the rod string, of internal carrier assembly 23 due to deformation of internal carrier assembly 23 during loading of the chuck jaw assemblies 31. Second, because of the angle of contact between bevelled surfaces 29*a* of flying wedges 29 and drive transfer rollers 25, rollers 25 provide a force, in addition to the force exerted by the wedging action of wedges 29 being driven by the rotation of drive basket 27 relative to carrier assembly 23, forcibly bringing chuck jaw wheel teeth 52 (FIGS. 10*a*, 10*b*, 11, 12, 13) into engagement with the rod string during the application of torque to the rod string.

Rotation of inner carrier assembly 23 with respect to carrier assembly drive basket 27 sets lock pin assemblies 32 and allows slip at the interface of drive transfer rollers 25 with flying wedges 29.

Spacer 30 and wear rings 30*a* are located between upper and lower support disks 28 and maintain the separation of the two support disks 28 so as to allow sliding rotary movement of flying wedges 29. The lock pins 32 passing through wedges 29 slide in a generally circumferential path in major curved slots 28*d* about rod string axis 33 when the lock pins are in their retracted state (which occurs while the diameter of the rod string is being changed or the core barrel is removed from the hole). The lock pins 32 also slide to a much more limited extent in one of a series of minor curved slots 28*f* (see also FIG. 8*a*) when the lock pin 32 is in its extended, or drilling, state. Wedges 29 pivot about the pin axis of lock pins 32. Wear rings 30*a* lie in contact with restraint bars 28*b*. Support disks 28, restraint bars 28*b*, wear rings 30*a*, and spacer 30 are fixedly secured to each other by a plurality of fasteners such as bolts 28*c*.

Tabs 31*a* of chuck jaws 31 seat in slots 28*a* of support disks 28 to assist in maintaining the chuck jaw assemblies 31 in proper position between support disks 28. Slots 28*a* further confine movement of chuck jaw assemblies 31 to movement in a radial direction relative to rod string axis 33. Radial positioning of chuck jaw assemblies 31 relative to rod string axis 33 is determined by the position of flying wedges 29 between restraint bars 28*b* and chuck jaw assembly rear load bearing surfaces 31*b*. The thicker the wedge section 73 of wedge 29 (FIG. 9*a*) between the opposed surfaces of restraint bars 28*b* and rear load bearing surfaces 31*b* of chuck jaws 31, the closer the chuck jaws 31 are to rod string axis 33.

Alternatively, rear load bearing surfaces 31*b* could be convexly curved so as to mate with the inside concave curved surfaces of wedges 29.

Drive transfer rollers 25 (FIG. 6) engage bevelled surfaces 29*a* on flying wedges 29. Sliding shafts 32*a* thread into caps 32*c* located on the outer sides (in an axial sense) of wedges 29. Sliding shafts 32*a* are conveniently of hexagonal cross-section so as to prevent rotation of lock pin assembly case 32*b* relative to support disks 28. This maintains the hydraulic port 32*y* (FIG. 8*b*) in the desired exterior position.

Figure 9A:
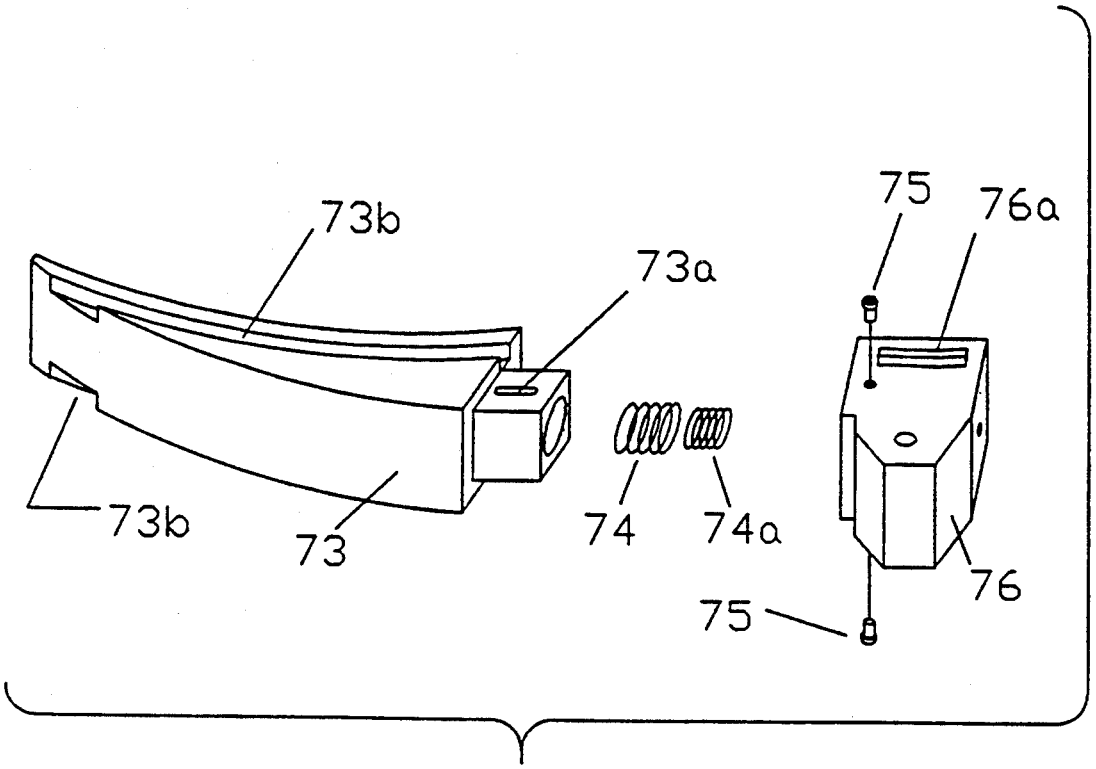
FIG. 9*a* is an exploded isometric view of a flying wedge assembly of FIG. 7.
Figure 9B:
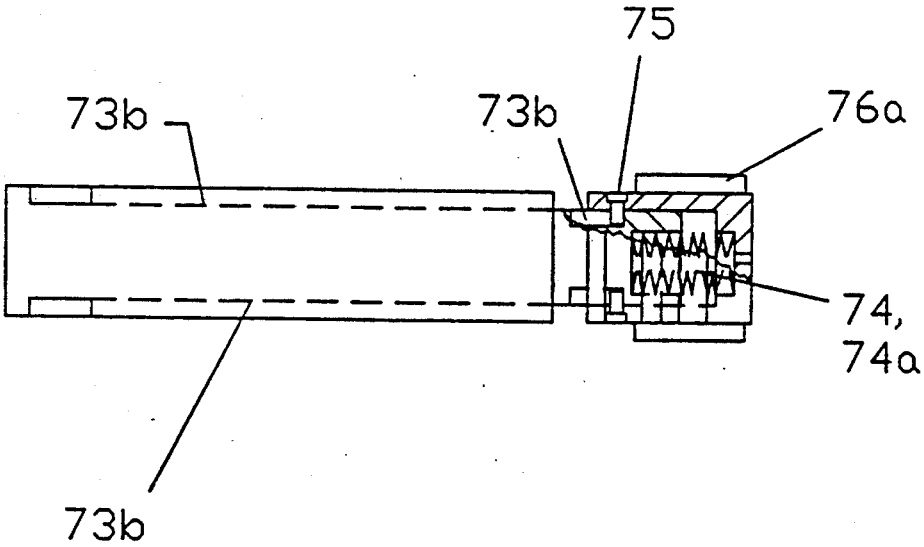
FIG. 9*b* is a partial side elevation section view of a flying wedge assembly of FIG. 7.

The position of wedges 29 relative to the rear surfaces 31*b* of chuck jaw assemblies 31 controls the relative radial positions of the chuck jaws 31. As illustrated in FIG. 9*a*, constant pressure is maintained on rear surfaces 31*b* by reason of the fact that wedges 29 are forced in the "tighten" direction by concentric compression spring pair 74, 74*a* positioned between wedge 73 and mounting block 76 of wedge assembly 29. The travel in these springs 74, 74*a* is limited by set screws 75 which extend into wedge slots 73*a*. Tabs 76*a* in wedge mount blocks 76 slidingly engage inner arcuate slots 28*e* in support disks 28.

Pins 46*b* (FIG. 10*c*) at the rear of the chuck jaw assemblies loosely engage slots 73*b* (FIG. 9*a*) in the flying wedges 29. This loose interconnection permits the chuck jaws to be pulled radially outwardly out of engagement with the rod string when the flying wedges 29 are counter-rotated.

Figure 8A:
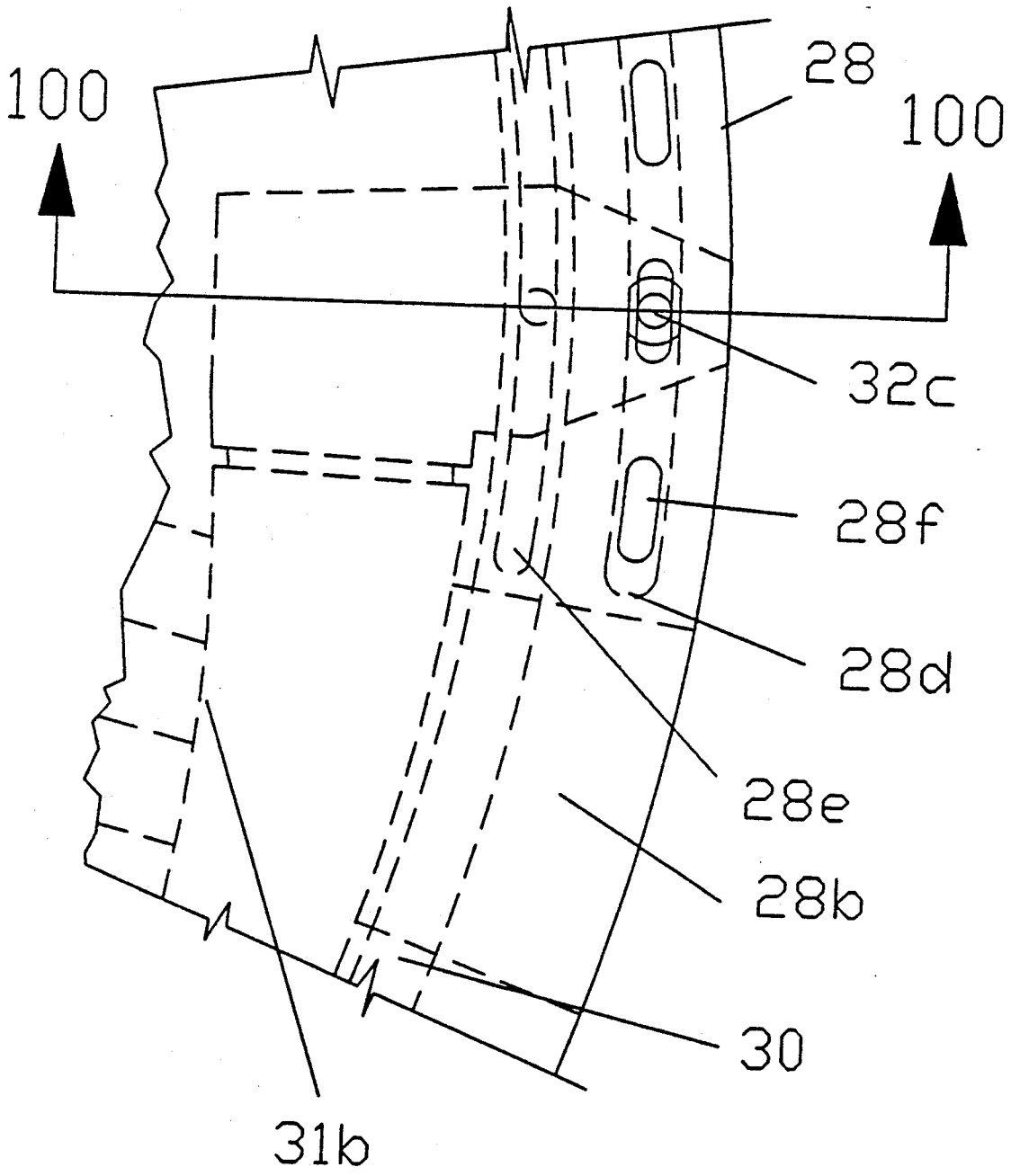
FIG. 8*a* is a partial plan view of a flying wedge shown in FIG. 7.

Note that holes 28*f* are formed as a series of curved slots (see FIG. 8*a*). They are arranged concentrically around rod string axis 33. The placement of these slots 28*f* determines the position of wedges 29 with respect to chuck jaw assemblies 31 and restraint bars 28*b*. In turn, this determines the diameter of the drill rod the chuck jaws will grip. Minor discrepancies in rod diameter for a given nominal diameter are compensated for by concentric springs 74, 74*a* in the wedge assemblies (see FIG. 9*a*).

Figure 8B:
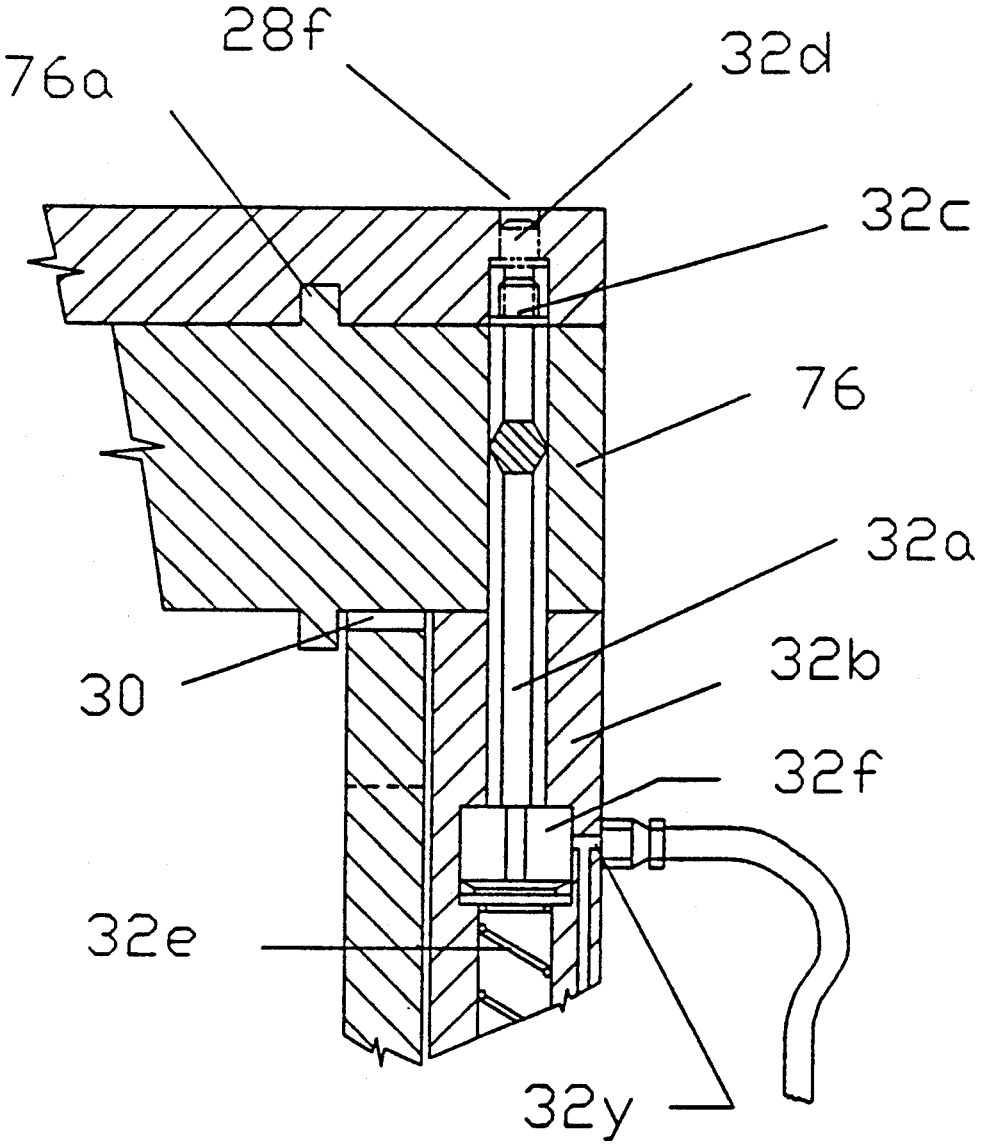
FIG. 8*b* is a side elevation section view of Detail 'A' (lock pin assembly) of FIG. 7 when assembled, taken along line 100—100 of FIG. 8*a*.
Figure 15:
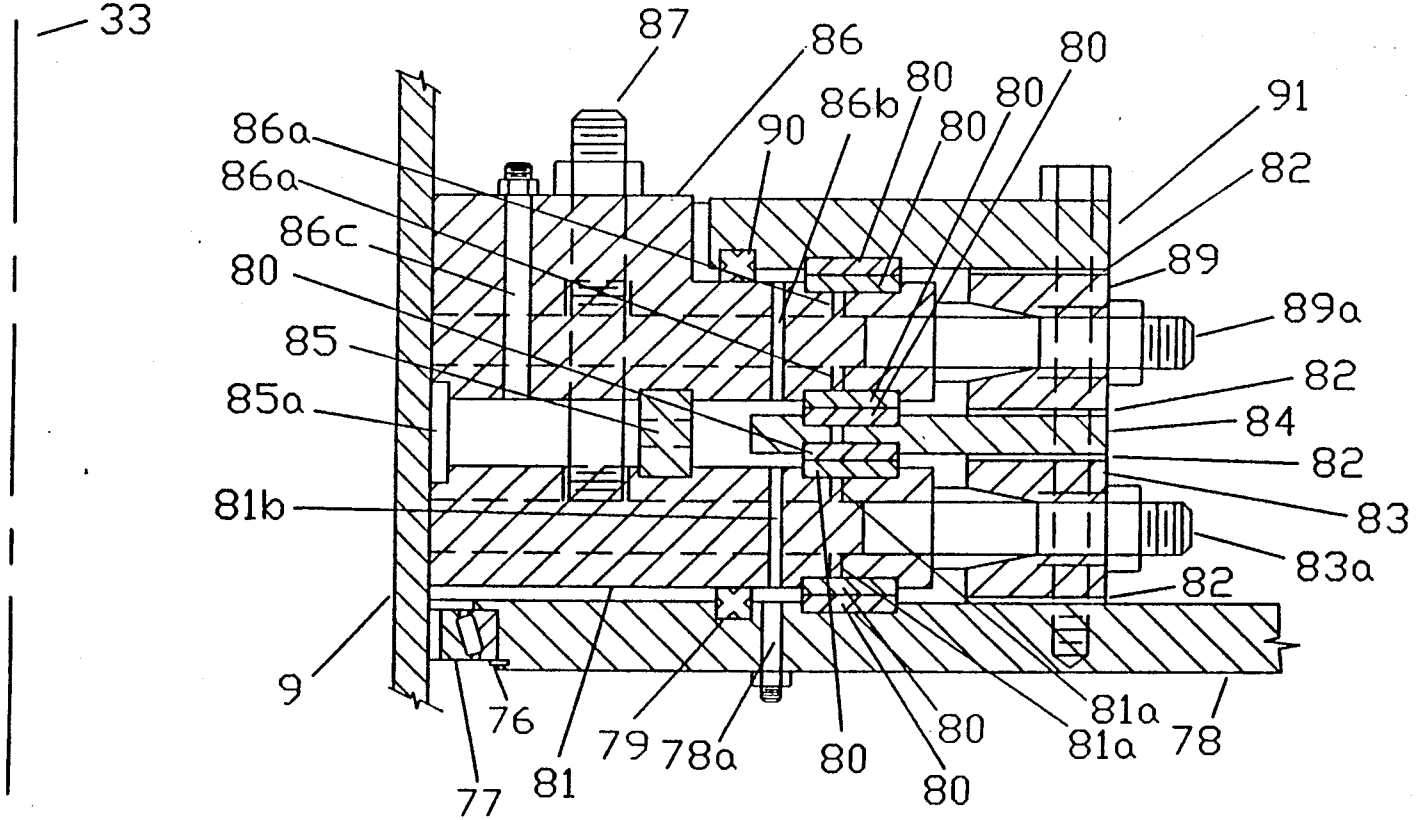
FIG. 15 is a partial cross-sectional detail view of the rotating fluid interface of FIG. 14 taken along plane 101—101 shown as a line 101—101 in FIG. 14.

FIG. 8*b* illustrates lock pin assembly 32 installed in assembled internal carrier assembly 23. Lock pin assembly 32 is symmetric both about its longitudinal axis and about a radial plane bisecting casing 32*b* through its centre. Consequently only one half of lock pin assembly 32 is illustrated in FIG. 8*b*; the other half is the mirror image of what is illustrated. Lock pin assembly 32 comprises a double acting hydraulic cylinder. Internal spring 32*e* operates so as to bias sliding shafts 32*a* in a normally extended position (shown in ghost outline in FIG. 8*b*). Hydraulic chambers 32*f* are ported to the rotating fluid interface dump line 78*a* (FIG. 15). Dump line 78*a* is usually at approximately atmospheric pressure. When dump line 78*a* is pressurized, and hence lock cylinder fluid chamber 32*f* is pressurized, the lock pin assembly sliding shafts 32*a* retract.

Under normal operating conditions, chuck jaw wheels 52 (see FIGS. 10*a*, 11) dig into the surface of the rod string so as to firmly retain the rod string in fixed relation to the internal carrier assembly 23. Chuck jaw wheels 52 are forced into the surface of the rod string when flying wedges 29 wedge between bearing surfaces 31*b* of chuck jaw assemblies 31 and restraint bars 28*b*. The force exerted on chuck jaw teeth 52 must be sufficient to dig the teeth into operative engagement with the sides of the rod string, preferably to a depth of at least 0.045 inches (although a lesser depth may be sufficient in some circumstances). Wedges 29 are driven into place between restraint bars 28*b* and chuck jaw assembly rear load bearing surfaces 31*b* through the reaction of flying wedges 29 with drive transfer rollers 25 and the engagement of caps 32*c* with holes 28*f* in drive disks 28. When they engage holes 28*d*, caps 32*c* are retracted from their normal position in grooves 28*f*. This occurs when lock pin shafts 32*a* are elongated by pressurizing chamber 32*f* so as to extend caps 32*c* into the position shown as phantom line 32*d* in FIG. 8*b*.

It can thus be seen that the flying wedges 29 each has a major circumferential position adjustment and a minor circumferential position adjustment. The major adjustment is permitted when the sliding shaft 32*a* of the associated lock pin assembly 32 is retracted out of engagement with one of the minor curved slots 28*f*, whilst engagement with its associated major curved slot 28*d*. The purpose of the major adjustment is to enable the flying wedges 29, and consequently the associated chuck jaw carrier assemblies 31, to move into the appropriate position relative to the size of rod string to be engaged by the chuck jaws (or, conversely, to move out of engagement with the rod string). Once the major adjustment is made and the rod string is gripped by the chuck jaws, the sliding shafts 32*a* of lock pin assemblies 32 are extended into engagement with the available minor curved slot 28*f*. The limitation on movement of the lock pins within the minor curved slots (see especially FIG. 8*a*) acts as a constraint on the associated permitted circumferential movement of the flying wedges 29. This ensures that whether or not torque is applied, the requisite minimum gripping force will be applied by chuck jaws 31 to the rod string.

When substantial torque is applied by drive motor 7 to the chuck jaw carrier assembly, drive transfer rollers 25 apply a force to wedges 29 which exceeds that applied to the wedge by the rod string. This forces cap 32*c* off the end of minor slot 28*f*, while at the same time driving the wedges into further engagement with tabs 28*b* and chuck jaw assemblies 31. This forces chuck jaw drive wheel 52 to further penetrate the rod string and provide increased grip. The maximum increased grip which may be obtained in this manner is limited by lock pin cap 32*c* striking the end of minor slot 28*f* and preventing further engagement of wedges 29.

Obviously the circumferential positions chosen for minor slots 28*f* should be coordinated with the expected diameters of rod string to be accommodated, so that when the chuck jaws engage the rod string with the desired degree of penetration, a corresponding minor slot 28*d* will be in alignment with sliding shaft cap 32*c* of the lock pin assembly 32.

When it is desired to open chuck jaws 31 the following operations are performed (see especially FIG. 15 with respect to the hydraulic fluid paths):

(a) The hydraulic dump return lines 78*a* for rotating fluid interfaces 8 and 20, which are normally above atmospheric pressure, are charged to a nominal back pressure, say 50–100 lb., by rerouting orifices 78*a* on the stationary side of the rotating fluid interface unit 8 or 20, as the case may be, from the dump tank to a low-pressure fluid power source by operation of a spool valve (conventional, not shown) (see FIG. 15);

(b) While holding the chuck jaw carrier assemblies stationary, for example with pin 1*c* inserted into the carrier assembly through hole 1*b* in the drill case, the drive motor 7 is turned in the "drilling", or clockwise direction. This moves the lock pin caps 32*c* off the end of their associated minor slots 28*f*, and leaves them free to retract under the back pressure applied in (a) into their associated major slots 28*d*.

(c) Now that the lock pins reside in their major slots 28*d*, the drive motor may be operated in the reverse direction to counter-rotate the flying wedge assemblies. This pulls the chuck jaw assemblies 31 outward through the interaction of pin 46*b* on the chuck jaw assembly with slot 73*b* of the associated flying wedge assemblies.

To close or tighten the chuck jaws 31, steps (a) to (c) above are repeated in the reverse order.

(a) The lock pins, still under pressure, are in their contracted state, and caps 32*c* lie in their associated major slots 28*d*. Pin 1*c* still locks the chuck jaw carrier assembly to the case.

(b) Drive motor 7 is operated in the "drilling", or clockwise direction. This rotates the flying wedges relative to the chuck jaw carrier, forcing the chuck jaws inward.

(c) While substantial torque is applied by drive motor 7 (counteracted by pin 1*c*) the spool valve applying back pressure to the fluid dump lines is returned to the "dump" position. This releases the fluid pressure in the lock pin assemblies allowing them to seat against the base of the major slot.

(d) The fluid pressure in drive motor 7 is released, removing the substantial torque applied in (c). The wedges back off until caps 32*c* are in a position to engage their associated minor slots. At this point, springs 32*e* force the caps into their minor slots and the chuck is set.

The above description of the use of pin 1*c* to lock the chuck jaw carrier to the case is meant to represent a preferred method only, and is not to disallow other means of locking the carrier, for example a hydraulically operated pin/hole combination existing between a carrier assembly drive disk 28 and the drill case.

Figures 10A, 10B:
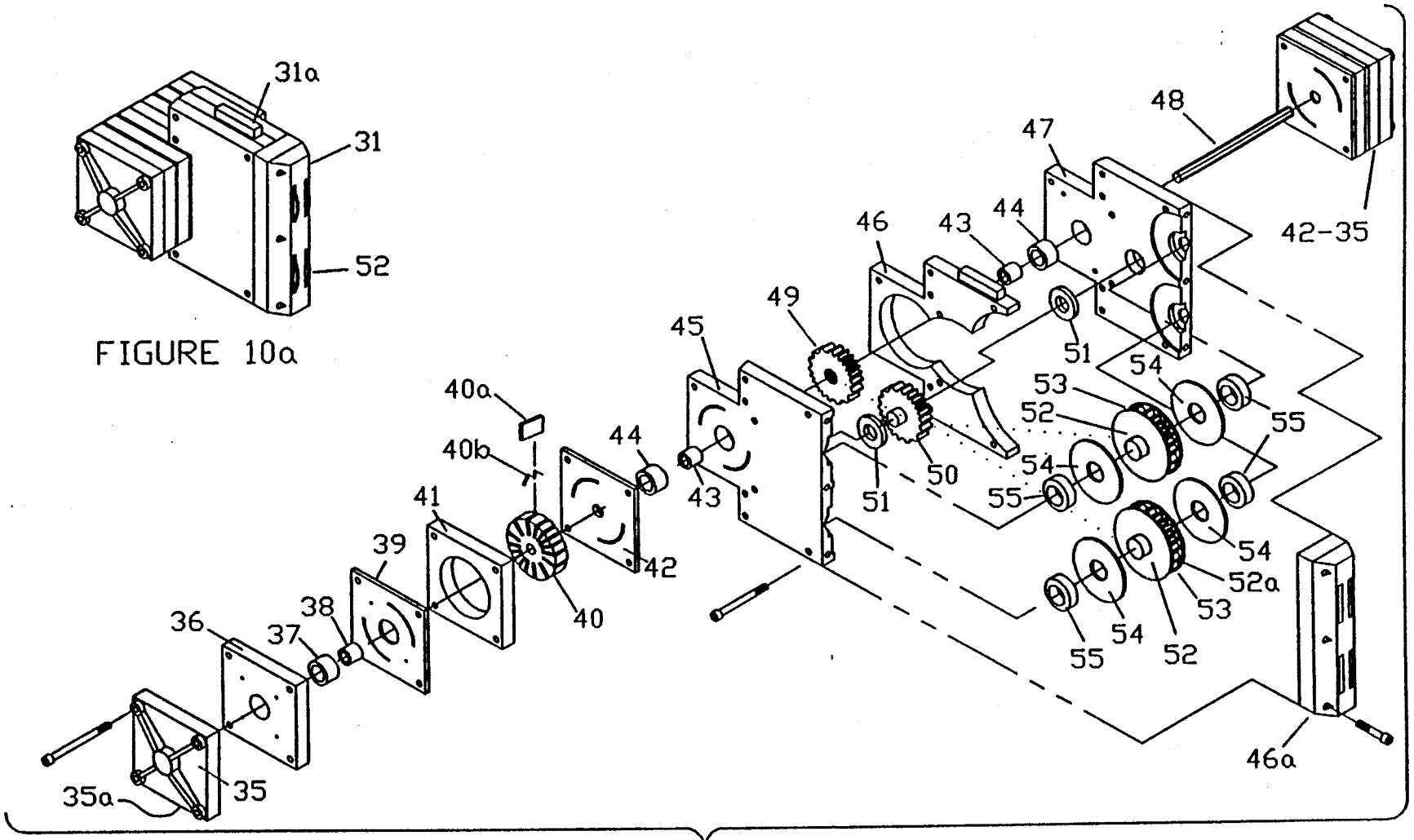
FIG. 10*a* is an isometric front view of a chuck jaw assembly, one of the components illustrated in FIG. 7.
FIG. 10*b* is an exploded isometric view of the chuck jaw assembly of FIG. 10*a*.

As illustrated in FIG. 10*b*, chuck jaw assembly 31 consists of a case (elements 45, 46*a*, 47), a pair of hydraulically actuated brakes 35, a gear train 49, 50, 53, having two parallel paths, and a pair of chuck jaw wheels 52. The purpose of the chuck jaw assembly 31 is to:

(a) transfer drive torque from chuck jaw carrier assemblies 11 and 18 (torque being supplied from transmission, 5, as shown in FIGS. 4 and 5, by output shafts 9 and 22 respectively) to the rod string;

(b) provide a thrust force to either advance or retract the rod string along rod string axis 33 by rotation of chuck jaw wheels 52;

(c) transfer the thrust force reaction to chuck jaw carrier assembly 11 and 18;

(d) provide a means to selectably lock chuck jaw wheels 52 so as to prevent their rotation and thus prevent the rod string from either advancing or retracting along rod string axis 33; and, (e) allow for operative engagement of teeth 52*a* on chuck jaw wheels 52 with the surface of the rod string.

Figure 10C:
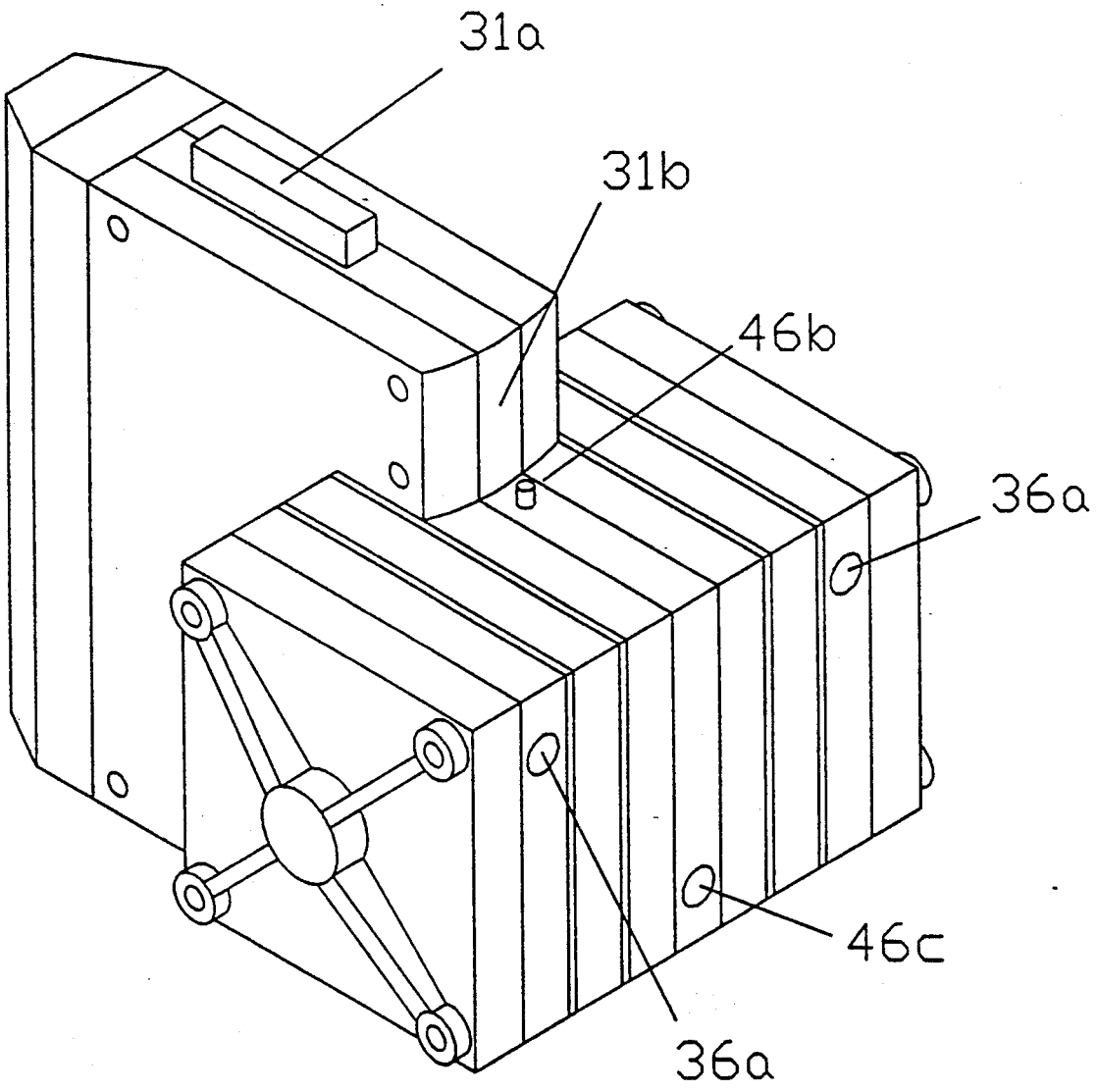
FIG. 10*c* is an isometric rear view of the chuck jaw assembly of FIG. 10*a*.

Hydraulic fluid is supplied to chuck jaw carrier assembly 31 through orifices 36*a*, 46*c* in the backs of vane motor hydraulic fluid port blocks 36 and 46 (FIG. 10*c*). Hydraulic fluid is supplied to the orifices on blocks 36 from a common header (not shown) which in turn is supplied from one set of orifices on the rotating side of the associated rotating fluid interface 8 (FIG. 4) or 20 (FIG. 5). In a similar manner, orifices on blocks 46 (FIG. 10*b*) are supplied from a common header which in turn is supplied from the remaining set of orifices on the associated rotating fluid interface 8 or 20. The orifices connected to blocks 36 are physically separate from orifices connected to blocks 46 and form separate hydraulic fluid flow paths. Hydraulic connections are made from the elements which remain stationary to the rotating fluid interface, which include the common headers above, and the components which move in relation to the rotating fluid interface, by means of flexible hydraulic hose. The lock pin assemblies, and hence fluid chambers 32*f*, are constrained in how far they can travel relative to the rotating fluid interface by the length of the major curved slots 28*d* in the support disks (in one suitable field embodiment, about 7 in.) Because of this, flexible hydraulic hose may be used to interconnect the lock pins with the fluid interface. A similar arrangement can be made for the chuck jaw assemblies, except that in the latter case, the required total travel is relatively short (about 1¼in. in a suitable field embodiment).

Vane motor fluid port block 36 routes fluid between its external orifice, vane motor port plate 39, and brake unit 35. Block 36 also acts as a rigid support for its associated vane motor bushing 37. Vane motor port plate 39 allows passage of hydraulic fluid between vane motor fluid port block 36 and vane motor housing 41, and serves as a wear surface for rotor 40 and the associated vanes 40*a* and springs 40*b* of rotor 40 within housing 41. External bearing sleeve 37 forms an interference fit with vane motor fluid port block 36. Sleeve 37 is the bearing of the journal-bearing combination 38-37. Journal sleeve 38 is slip-fit on shaft 48. Sleeve 38 is constrained by vane motor port plate 39 and chuck jaw wheel brake 35. Vane motor port plate 42 performs the same functions as vane motor port plate 39.

Bearing blocks 45 and 47 perform a variety of functions. They provide a fluid path from port plate 42 to an external fluid orifice (not shown) at the rear of port block 46. They provide a mounting and bearing surface and lubrication pathways for bearing sleeves 44, 51, and 55. They transfer forces from chuck jaw wheels 52 to chuck jaw assembly tabs 31*a* (and thence to carrier assembly 23 via drive platter 28). Finally, they also transfer forces from flying wedges 29 to the chuck jaw teeth without having these forces propagate through shaft 48 and its associated parts or idler gear 50.

The chuck jaw wheel assembly consists of components 52 through 55. Chuck jaw wheels 52 have teeth 52*a* to grip the rod string. Chuck jaw wheels 52 transfer reaction forces to gear 53 through a plurality of shear pins (not shown). Thrust washers 54 support lateral thrust developed between the rod string and chuck jaw assembly 31. Thrust washers 54 reside in machined lands in bearing blocks 45 and 47 and chuck jaw assembly cap 46*a*. Bearing sleeves 55 support bearing forces developed between the rod string and chuck jaw assembly 31 and also reside, as an interference fit, in machined lands in bearing blocks 45 and 47 and chuck jaw assembly cap 46*a*.

The rod string is raised or lowered by fluid pressure applied to vane motor assemblies 36–42. The torque is transferred through thrust force transfer gears 49 and 53 and idler gear 50. Gear 49 is a slide fit on splined shaft 48. Gear 50 is an idler gear supported by bearing sleeves 51 which reside in machined lands in bearing blocks 45 and 47 as an interference fit.

Splined shaft 48 is of full floating type, all interconnected components being a slide fit. It is constrained by thrust surfaces in chuck jaw wheel brake 35.

The purpose of chuck jaw brake 35 is to provide a means whereby chuck jaw wheels 52 may be selectively prevented from rotating. This allows the drill, and in particular carrier assembly 23, to hold the rod string suspended from the chuck jaw wheels.

Figure 16:
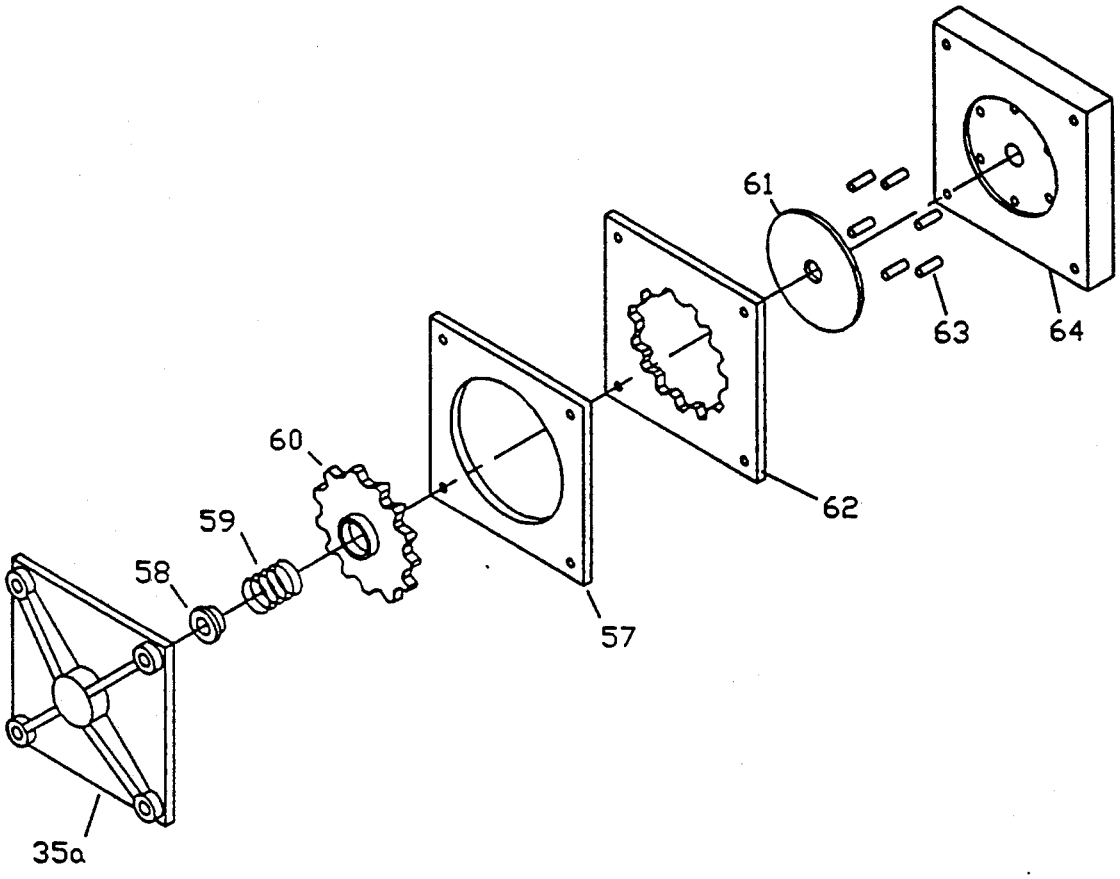
FIG. 16 is an exploded isometric view of the chuck jaw wheel brake assembly of FIG. 10*b*.

Brake 35 (whose components are shown in detail FIG. 16) operates as a hydraulically actuated chuck jaw wheel brake. Not shown in FIG. 16 is end cap 35*a*, illustrated in FIG. 10*b*. End cap 35*a* resides in contact with brake block 57, on the left side of the block as shown in FIG. 16. Brake block 57 is a spacer to allow room for brake sprocket 60 to disengage sprocket mating block 62. Sprocket 60 has internal splines for sliding engagement with the external splines on shaft 48. Spring seat/thrust washer 58 is a seat for sprocket return spring 59 and acts as a thrust washer for shaft 48. There is sufficient space in end cap 35*a* to house the compression spring 59 and seat 58. Seat 58 and sprocket 60 are mounted on floating shaft 48 as a slide fit. Washer 61 is a slip washer and acts as a sliding surface on which hydraulic lock release pistons 63 act.

Lock release piston block 64 contains a plurality of hydraulic lock release pistons 63 evenly spaced in a circular symmetric array around shaft 48. Fluid to operate the lock release cylinders is ported from each of the two sides of vane motor assemblies 39–42 through orifices (not shown) in port block 36 and orifices (not shown) in piston block 64 to the rear of block 64 as depicted in FIG. 16. Each side of the vane motor assemblies actuates alternate pistons 63 in piston block 64. The two fluid paths remain independent.

Under conditions where chuck jaw wheels 52 are required to rotate, brakes 35 are released by applying fluid pressure to vane motor port blocks 36 so as to engage the vane motors. Pressurized fluid is thus forced from the vane motor assemblies to actuate lock release pistons 63. The fluid pressure pushes lock release pistons 63 out, moving sprocket 60 into block 57 allowing shaft 48 to rotate. A hydraulic fluid feed control valve to engage the vane motors is located on the hydraulic control board (not shown). The control valve may be readily installed by those familiar with the art.

Under conditions where chuck jaw wheels 52 are required to remain fixed, hydraulic fluid feed to the vane motors is shut off and the pressure bled off by dumping the hydraulic fluid keeping pistons 63 extended to the hydraulic reservoir (not shown). This allows spring 59 to push sprocket 60 into engagement with sprocket mating block 62, preventing shaft 48 from turning.

Figure 11:
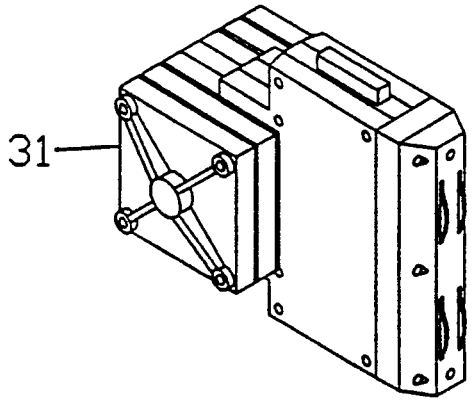
Figure 12:
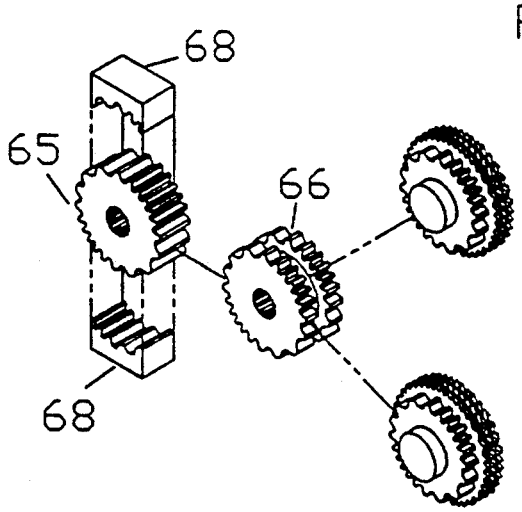
Figure 13:
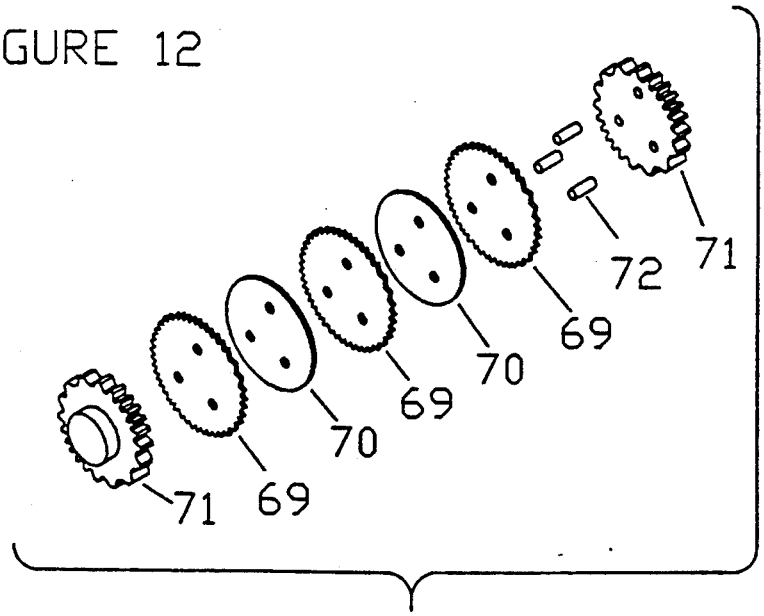

An alternative configuration of the chuck jaw assembly is disclosed in Figures 11, 12 and 13. In this configuration, the brakes are moved to the centre of the assembly and the chuck jaw wheels are replaced by wheels composed of three toothed wheel/spacer assemblies sandwiched between two driving gears. This alternative embodiment differs from the embodiment illustrated in FIGS. 10*a*, 10*b* in the following manner:

(a) gear 49 (FIG. 10*b*) is replaced by gear 65 (FIG. 12);

(b) gear 50 (FIG. 10*b*) is replaced by twin gear -spacer combination 66 (FIG. 12);

(c) chuck jaw wheel assemblies 52–53 (FIG. 10*b*) are replaced by chuck jaw wheel assemblies 69–72 (FIG. 13);

(d) the relative position of the driven gear - chuck jaw teeth in the chuck jaw wheel assemblies have been interchanged; and, (e) chuck jaw brake assemblies 57–64 (FIG. 10*b*) are replaced by brakes 68 (FIG. 12).

Brakes 68 may conveniently be located in rectangular cylinders (not shown) in the chuck jaw assembly case. These may be connected to hydraulic cylinder -spring combinations (not shown) inside the chuck jaw assembly case and would work in a manner analogous to the brake assemblies 35 of FIGS. 10*b* and 16. The case dimensions and bearing sleeve dimensions would have to be adjusted accordingly.

Chuck jaw wheel assemblies 69–72 are composed of the following components: two external gear/journals 71; three chuck jaw teeth wheels 69; two chuck jaw tooth spacers 70; three torque transfer/assembly pins 72.

As illustrated in FIG. 15, rotating fluid interface units 8 and 20 each consist of two independent chambers, each with fluid orifices on both rotating and stationary sides, and a low pressure return chamber. The purpose of the rotating interface is to provide two independent high pressure fluid interface ports and one low pressure dump port. One high pressure port has three outlets 87 on the rotating side of the fluid interface and three outlets 83*a* to the stationary side of the rotating fluid interface. The other high pressure port has three outlets 88 on the rotating side of the fluid interface and three outlets 89*a* to the stationary side of the rotating fluid interface. The low pressure dump port has two orifices 78*a* on the stationary side of the rotating fluid interface and two ports 86*c* on the rotating side. The ports on the rotating side of the fluid interface are continuously addressable from their associated ports of the stationary side of the fluid interface. They allow the supply and removal of hydraulic fluid required for operation of their associated chuck jaw carrier assemblies.

Figure 14:
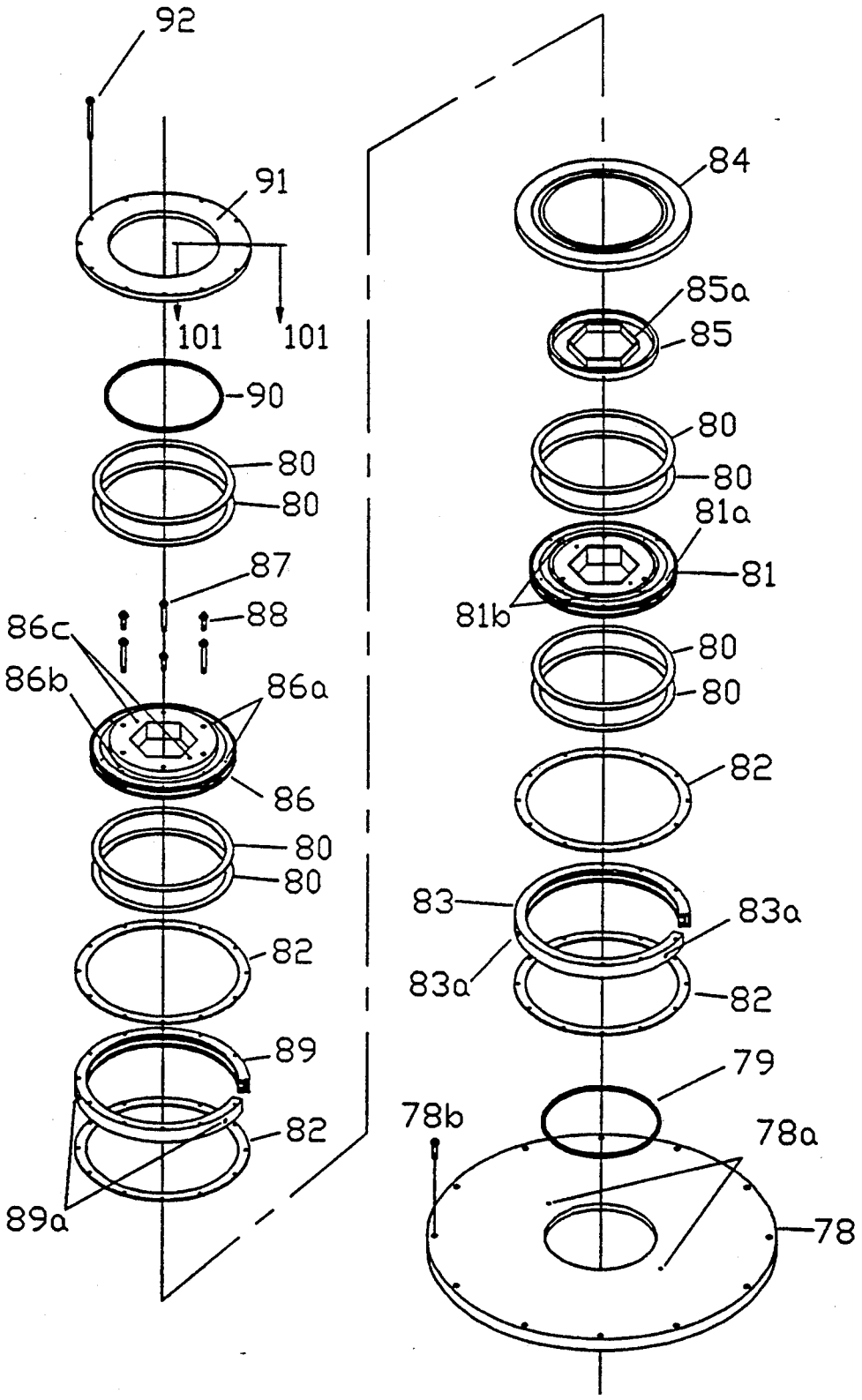

Rotating fluid interface top plate 78 (FIGS. 14 and 15) attaches to drill case A (FIG. 3) through a plurality of fasteners (not shown) about its circumference. Bearing 77, although shown as a single unit in FIG. 14, is composed of a bearing and inside hexagonal-to-circular ring, as indicated in FIG. 15. It is retained by snap ring 76 and allows rotation of the internal components relative to the stationary drill case.

Low pressure seal 79 seats rotor 81 and forms a low pressure seal between rotor 81 and stationary case A. Its purpose is to force fluid which leaks past high pressure seal pair 80 through return orifices 78*a*. Seal 79 is shown as a lip seal with an internal garter spring. Alternative embodiments might include, for example, a ceramic ring/elastomeric runner, cross type elastomeric ring seal, or rectangular cross-section ring seal (not shown), substituted with suitable alterations to the seal seat in rotor 81.

Rotors 81 and 86 may be either of single piece construction or of a composite nature, that is, composed of two external disks and an internal spacer and associated gaskets.

High pressure face seals 80 form a viscosity induced pressure gradient seal to keep the pressure low in return orifice 78*a* and the pressure high in the cavity defined by rotors 81 and 86 and rotor housings 83 and 89. A controlled pressure differential is maintained between the mating surfaces of high pressure seals 80 through a plurality of small spring-loaded spool valves (not shown) located between orifices 81*a*, 86*a* and the interior of rotors 81 and 86 respectively.

Gaskets 82 form a seal between rotor housings 83 and 89 and their associated cover plates: top plate 78 and cover plates 84 and 91. Rotors 81 and 86 rotate congruent with the rod string. Rotating fluid interface 8 is mounted on hexagonal output shaft 9 (FIG. 4) and rotating fluid interface 20 is mounted on hexagonal output shaft 22 (FIG. 5).

Spacer combination 85, 85*a* maintains rotors and 86 at the proper separation and provides a collection cavity for fluid leaking past associated seals 80.

Tubes 87 and 88 (also indicated on FIG. 5) provide fluid paths on the rotating side of the rotational fluid interface. Tubes 87 pass entirely through rotor assembly 86 and provide a fluid path for fluid resident in rotor 81. Tubes 88 pass through one side of rotor 86 only, and provide a fluid path for fluid resident in rotor 86. The resulting rotating fluid orifices take fluid to and from their associated chuck jaw carrier assemblies.

Low pressure seal 90 is a lip seal with an internal garter spring. It seats in cover 91 and forms a low pressure seal between rotor 86 and stationary cover 91. Its purpose, in conjunction with seal 79, is to force fluid which leaks past high pressure seal pairs 80 through return orifice 78*a* located in top plate 78. Fluid is routed to top plate 78 through passages 81*b*, 86*b* through rotors 81 and 86. Return orifice 78*a* is normally ported to the hydraulic reservoir at near atmospheric pressure, but may be charged to a small positive pressure while the lock pins 32 are disengaged.

In an alternative embodiment, chuck jaw brakes 35 and lock pin assemblies 32 could be provided with their own isolated fluid circuits. The present embodiment allows for the addition of another rotor and cover, and additional tubes, etc. to provide an additional fluid passage between the rotating and stationary sides of the rotating fluid interface.

A drill drive properly constructed in accordance with the foregoing teachings and with accepted engineering practice should be capable of achieving the following performance objectives:

(1) It will be capable of rotating the rod string over a useful range, from 0 to 1800 revolutions per minute (r.p.m.) or higher, with a minimum top speed of 1300 r.p.m. Maximum applied stall torque should approach 4000 ft-lb.

(2) It will be capable of providing a push or a pull on the rod string as required. For rod diameters of from two to four inches, for depths of up to 3000 ft., this force is in the range of 0–24000 lb. This force should be controllable to ±100 lb. or so, and should not change as the r.p.m. is adjusted (hence the preferred use of two oppositely charged vane motors per chuck jaw assembly in the disclosed invention, to neutralize Coriolis forces, or, as a variant, the use of a single vane motor with inlet (outlet) ports on the two sides of the motor, and an cutlet (inlet) port at the centre of the vane motor).

(3) Properties (1) and (2) should be linearly independent.

(4) It will be capable of keeping the rod string suspended in an empty hole (hence the locking mechanism 57–64).

Figure 1:
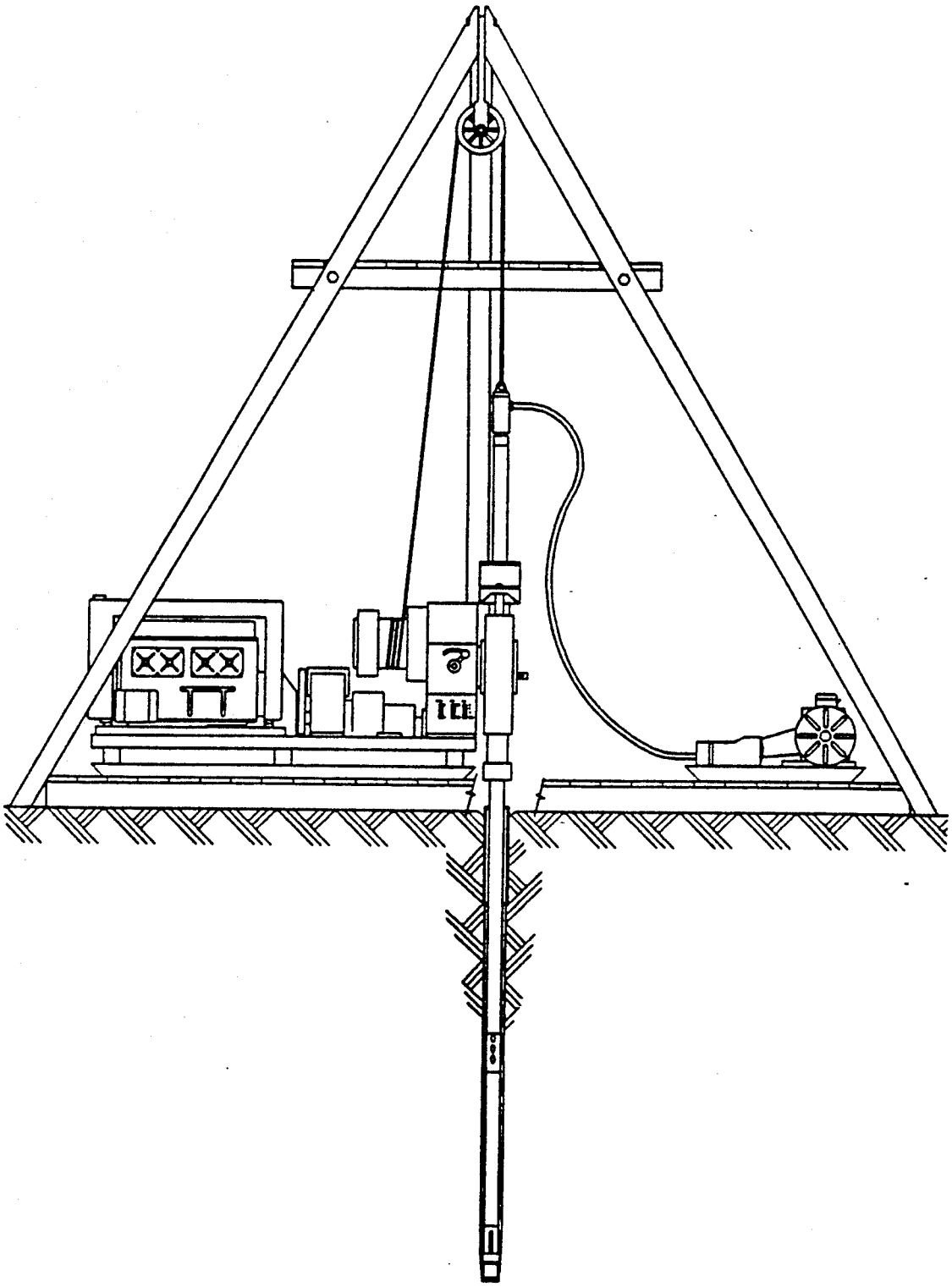
FIGURE 1 PRIOR ART
FIG. 1 is a partial cut-away side elevation view of a prior art diamond drill operation.
Figure 2:
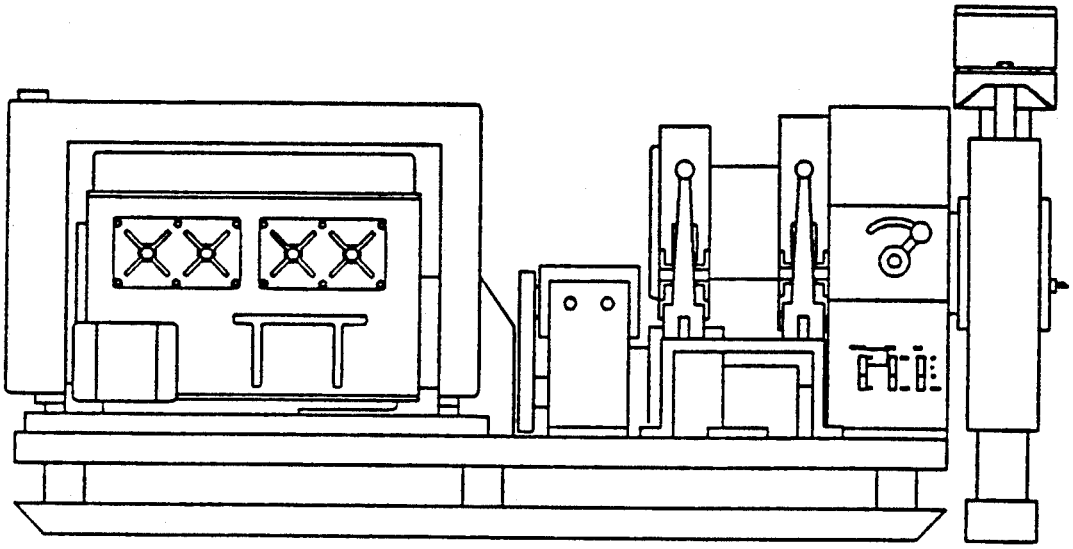
FIGURE 2 PRIOR ART
FIG. 2 is a perspective view of a prior art diamond drill engine, hoist and drilling head.

(5) The drill is helicopter-portable. (The slung parts easily "drop into place" on one another, and the drill is easily disassembled into pieces weighing, say, 800 lb. or less. The weight of the drill should be as little as possible, and yet the drill must not be so light it is easily pushed off the setup frame. The optimum location for the centre of gravity of the drill is therefore directly over the hole, as accomplished in the disclosed design. This is an improvement over typical prior art, as illustrated in FIGS. 1 and 2 in which the major portion of the prior art drill is located away from the axis of the hole.)

(6) The drill can be constructed in such a manner as to be easily converted from a surface drill (as shown) to an underground drill (by mounting the drill on an articulated arm, or on a flat car, or on a rubber tire carrier, etc.). This is accomplished by having the drill constructed to articulate about two pins on the exterior of the canister assembly.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A drive assembly comprising a prime mover, upper chuck assembly, lower chuck assembly and a transmission for controllably and reversibly imparting rotary power from the prime mover to the chuck assemblies, all being coaxial with the driven axis and each having an axial cavity for receiving a shaft to be rotatably driven and moved axially;

within each chuck assembly, means for gripping and imparting continuous axial movement in either direction to the shaft; and, clutch or spline means for selectably engaging and disengaging each said chuck assembly from the prime mover.

2. A drive assembly as defined in claim 1, additionally comprising locking means for preventing the rotary motion of at least one of said chuck assemblies.

3. A drive assembly as defined in claim 1, wherein the prime mover, and chuck assemblies, are hydraulically operated.

4. A drive assembly as defined in claim 3, additionally comprising fluid interface means for translating hydraulic power obtained form a non-rotating source to hydraulic power operable within each of said hydraulically operated elements.

5. For use in a drive assembly, a chuck jaw assembly comprising rotatable support means having a hollow centre for receiving a shaft;

a plurality of symmetrically arranged chuck jaws each having a radially inward face and mounted for floating radial movement on said support means, means in the vicinity of the radially inward face of each of said chuck jaws for gripping the shaft between said chuck jaws and for controllably imparting continuous axial movement in either direction to the shaft; and means for controllably imparting a radially inward force to each of the chuck jaws in proportion to the torque applied to the shaft.

6. A chuck jaw assembly as defined in claim 5, wherein the means for imparting radially inward force to the chuck jaws translates rotary force to radial force.

7. A chuck jaw assembly as defined in claim 6, wherein the means for imparting radially inward force to each of the chuck jaws comprises wedge means interposed between a peripherally located abutment fixed to the support means and a radially outward bearing surface of the associated chuck jaw.

8. A chuck jaw assembly as defined in claim 7, additionally comprising means for varying the circumferential position each of the wedge means thereby to vary the size of the opening between the radially inward faces of the chuck jaws.

9. A chuck jaw assembly as defined in claim 8, wherein the circumferential position varying means has a major adjustment capability and a minor adjustment capability, the major adjustment capability being to accommodate shafts of varying diameters, and the minor adjustment capability being to maintain at least a minimum gripping force on the shaft regardless of the torque applied to the chuck jaw assembly.

10. A chuck jaw assembly as defined in claim 5, wherein the gripping means comprises wheels rotatably mounted in the chuck jaws about axes which lie in a plane perpendicular to the axis of the shaft and which are tangential to a circle lying in said plane, centred on said shaft axis.

11. A chuck jaw assembly as defined in claim 10, wherein the peripheries of the wheels are toothed to grip the shaft.

12. Drill drive apparatus for a drill rod string, comprising:

a hydraulically operated drive motor concentrically mounted about the axis of rotation of the drill rod string and operatively connected to a chuck jaw carrier assembly for rotating said chuck jaw carrier assembly about said axis;

said chuck jaw carrier assembly having a concentric aperture for receiving and gripping the drill rod string;

said chuck jaw carrier assembly comprising a plurality of spaced floating chuck jaws mounted in an array about the aperture for slidable radial movement within said chuck jaw carrier assembly, and wedge assemblies circumferentially slidably and pivotally mounted in spaced circumferential array near the periphery of said chuck jaw carrier assembly, said wedge assemblies in response to rotation of the chuck jaw carrier assembly forcing said chuck jaws into removable engagement with the outer surface of said drill pipe;

said chuck jaws further comprising at their inner faces chuck jaw wheels;

said chuck jaws further comprising hydraulically operated motors operatively engaging said chuck jaw wheels;

said chuck jaw wheels having toothed outer surfaces for gripping engagement with said drill pipe.

13. Apparatus as defined in claim 12 wherein the axes of rotation of said chuck jaw wheels lie in a plurality of planes substantially orthogonal to said axis of rotation of said chuck jaw carrier assembly and to said drill rod string axis.

14. Apparatus as defined in claim 13 additionally comprising a second said chuck jaw carrier assembly mounted for driven rotation by the drive motor selectably independently of the drive of the first mentioned chuck jaw carrier assembly and axially spaced from the first mentioned chuck jaw assembly.

15. Apparatus as defined in claim 14, having circular symmetry throughout.

16. For use in a drive assembly, a chuck: jaw assembly comprising rotatable support means having a hollow centre for receiving a shaft;

a plurality of symmetrically arranged chuck jaws each having a radially inward face and mounted for floating radial movement on said support means, means in the vicinity of the radially inward face of each of said chuck jaws for gripping the shaft between said chuck jaws; and wedge means for controllably imparting a radially inward force to each of the chuck jaws, said wedge means being interposed between a peripherally located abutment fixed to the support means and a radially outward bearing surface of the associated chuck jaw.

17. A chuck jaw assembly as defined in claim 16, additionally comprising means for varying the circumferential position each of the wedge means thereby to vary the size of the opening between the radially inward faces of the chuck jaws.

18. A chuck jaw assembly as defined in claim 17, wherein the circumferential position varying means has a major adjustment capability and a minor adjustment capability, the major adjustment capability being to accommodate shafts of varying diameters, and the minor adjustment capability being to maintain at least a minimum gripping force on the shaft regardless of the torque applied to the chuck jaw assembly.

* * * * *